US010667984B2

(12) United States Patent
Brosnan et al.

(10) Patent No.: US 10,667,984 B2
(45) Date of Patent: Jun. 2, 2020

(54) SYSTEMS AND METHODS FOR OPERATING PATIENT THERAPY DEVICES

(71) Applicant: Stryker Corporation, Kalamazoo, MI (US)

(72) Inventors: Daniel Brosnan, Kalamazoo, MI (US); Marko N. Kostic, Portage, MI (US); Sean Robert Hadley, Christchurch (NZ)

(73) Assignee: Stryker Corporation, Kalamazoo, MI (US)

( * ) Notice: Subject to any disclaimer, the term of this patent is extended or adjusted under 35 U.S.C. 154(b) by 533 days.

(21) Appl. No.: 15/369,093

(22) Filed: Dec. 5, 2016

(65) Prior Publication Data

US 2017/0172838 A1 Jun. 22, 2017

Related U.S. Application Data

(60) Provisional application No. 62/269,748, filed on Dec. 18, 2015.

(51) Int. Cl.
*A61H 9/00* (2006.01)

(52) U.S. Cl.
CPC ... *A61H 9/0078* (2013.01); *A61H 2201/0103* (2013.01); *A61H 2201/0184* (2013.01); *A61H 2201/10* (2013.01); *A61H 2201/164* (2013.01); *A61H 2201/165* (2013.01); *A61H 2201/50* (2013.01); *A61H 2201/5043* (2013.01);
(Continued)

(58) Field of Classification Search
CPC ..... A61H 9/00; A61H 9/0007; A61H 9/0021; A61H 9/005; A61H 9/0078; A61H 9/0092; A61H 11/00; A61H 2011/005; A61H 2201/0103; A61H 2201/0157; A61H 2201/0173; A61H 2201/0184; A61H 2201/02; A61H 2201/0242; A61H 2201/1238; A61H 2201/1246; A61H 2201/164; A61H 2201/165; A61H 2201/50; A61H 2201/5005; A61H 2201/5007; A61H 2201/5051; A61H 2201/5056; A61H 2201/5058; A61H 2201/5061; A61H 2201/5064; A61H 2201/5069; A61H 2201/5071; A61H 2201/5082; A61H 2201/5084; A61H 2201/5087; A61H 2203/04; A61H 2205/02; A61H 2205/06; A61H 2205/08; A61H 2205/084; A61H 2205/10; A61H 2205/12; A61H 2209/00; A61H 2230/505; A61H 2230/625
USPC ..... 601/15, 134, 148, 149, 150, 151, 152; 606/202
See application file for complete search history.

(56) References Cited

U.S. PATENT DOCUMENTS 5,370,603 A * 12/1994 Newman ..... A61H 9/0078 601/150
5,630,238 A 5/1997 Weismiller et al.
(Continued)

FOREIGN PATENT DOCUMENTS

GB 2214678 A 9/1989

*Primary Examiner* — Timothy A Stanis
*Assistant Examiner* — Charles M Vivian
(74) *Attorney, Agent, or Firm* — Howard & Howard Attorneys PLLC

(57) ABSTRACT

A detection system for patient therapy devices is provided. A controller is coupled to the detection system. The controller determines a desired operational parameter based on the type of patient therapy device detected.

13 Claims, 19 Drawing Sheets

(52) U.S. Cl.
CPC ..... *A61H 2201/5048* (2013.01); *A61H 2201/5064* (2013.01); *A61H 2201/5069* (2013.01); *A61H 2201/5071* (2013.01); *A61H 2201/5082* (2013.01); *A61H 2201/5084* (2013.01); *A61H 2201/5087* (2013.01); *A61H 2201/5097* (2013.01); *A61H 2205/106* (2013.01); *A61H 2205/108* (2013.01); *A61H 2205/12* (2013.01)

(56) References Cited

U.S. PATENT DOCUMENTS

| | | | | |
|---|---|---|---|---|
| 5,713,856 | A | 2/1998 | Eggers et al. | |
| 5,843,007 | A | 12/1998 | McEwen et al. | |
| 6,062,244 | A | 5/2000 | Arkans | |
| 6,231,532 | B1 | 5/2001 | Watson et al. | |
| 6,387,065 | B1 | 5/2002 | Tumey | |
| 6,440,093 | B1 | 8/2002 | McEwen et al. | |
| 6,544,202 | B2 | 4/2003 | McEwen et al. | |
| 6,735,799 | B1 | 5/2004 | Ellis et al. | |
| 6,736,787 | B1 | 5/2004 | McEwen et al. | |
| 6,829,796 | B2 | 12/2004 | Salvatini et al. | |
| 6,884,255 | B1 | 4/2005 | Newton | |
| 6,988,423 | B2 | 1/2006 | Bolam et al. | |
| 7,017,208 | B2 | 3/2006 | Weismiller et al. | |
| 7,076,993 | B2 | 7/2006 | Cook | |
| 7,256,771 | B2 | 8/2007 | Novak et al. | |
| 7,354,410 | B2 | 4/2008 | Perry et al. | |
| 7,354,411 | B2 | 4/2008 | Perry et al. | |
| 7,398,803 | B2 | 7/2008 | Newton | |
| 7,490,620 | B2 | 2/2009 | Tesluk et al. | |
| 7,591,796 | B1 | 9/2009 | Barak et al. | |
| 7,641,623 | B2 | 1/2010 | Biondo et al. | |
| 7,741,966 | B2 | 6/2010 | Bonnefin et al. | |
| 7,810,519 | B2 | 10/2010 | Tesluk et al. | |
| 7,904,976 | B2 | 3/2011 | Hakamiun et al. | |
| 7,909,786 | B2 | 3/2011 | Bonnefin et al. | |
| 8,235,922 | B2 | 8/2012 | Rowe et al. | |
| 8,256,459 | B2 | 9/2012 | Tesluk et al. | |
| 8,257,286 | B2 | 9/2012 | Meyer et al. | |
| 8,257,287 | B2 | 9/2012 | Hanlon et al. | |
| 8,287,517 | B2 | 10/2012 | Hanlon et al. | |
| 8,506,507 | B2 | 8/2013 | Bock | |
| 8,578,939 | B1 * | 11/2013 | Kimani Mwangi | A61F 5/56 128/848 |
| 8,585,622 | B2 | 11/2013 | Mros et al. | |
| 8,734,369 | B2 | 5/2014 | Perry et al. | |
| 8,758,282 | B2 * | 6/2014 | Malhi | A61H 9/0092 601/149 |
| 8,845,562 | B2 | 9/2014 | Receveur et al. | |
| 9,642,759 | B2 | 5/2017 | Stryker et al. | |
| 9,737,454 | B2 * | 8/2017 | Hornbach | A61H 7/00 |
| 2010/0076356 | A1 | 3/2010 | Biondo et al. | |
| 2011/0245743 | A1 * | 10/2011 | Eddy | A61H 9/0078 601/151 |
| 2013/0014324 | A1 | 1/2013 | Receveur et al. | |
| 2013/0102939 | A1 * | 4/2013 | Sudarev | A61B 5/0225 601/151 |
| 2013/0231596 | A1 | 9/2013 | Hornbach et al. | |
| 2013/0282047 | A1 | 10/2013 | Hanlon et al. | |
| 2013/0331748 | A1 | 12/2013 | Wright et al. | |
| 2014/0031730 | A1 | 1/2014 | Hornbach et al. | |
| 2014/0058301 | A1 | 2/2014 | Mros et al. | |
| 2014/0094726 | A1 | 4/2014 | Malhi et al. | |
| 2014/0207036 | A1 | 7/2014 | Perry et al. | |
| 2014/0249458 | A1 | 9/2014 | Malhi et al. | |
| 2015/0094623 | A1 | 4/2015 | Howell et al. | |
| 2015/0202116 | A1 * | 7/2015 | Wright | A61H 9/0078 601/150 |
| 2016/0008005 | A1 * | 1/2016 | McEwen | A61B 5/02233 606/202 |
| 2016/0166463 | A1 * | 6/2016 | Douglas | A61H 9/0078 601/150 |
| 2016/0166464 | A1 * | 6/2016 | Douglas | A61H 9/0078 601/148 |

* cited by examiner

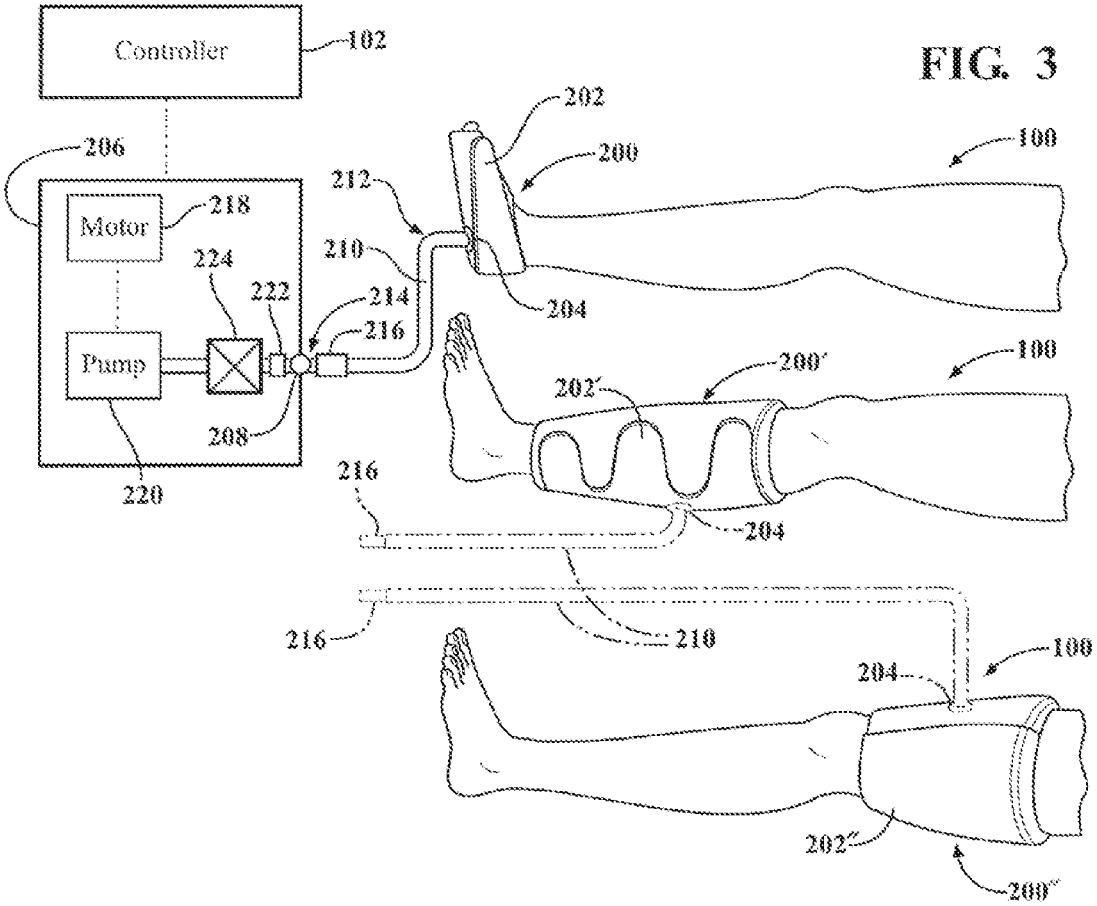
FIG. 3
FIG. 4
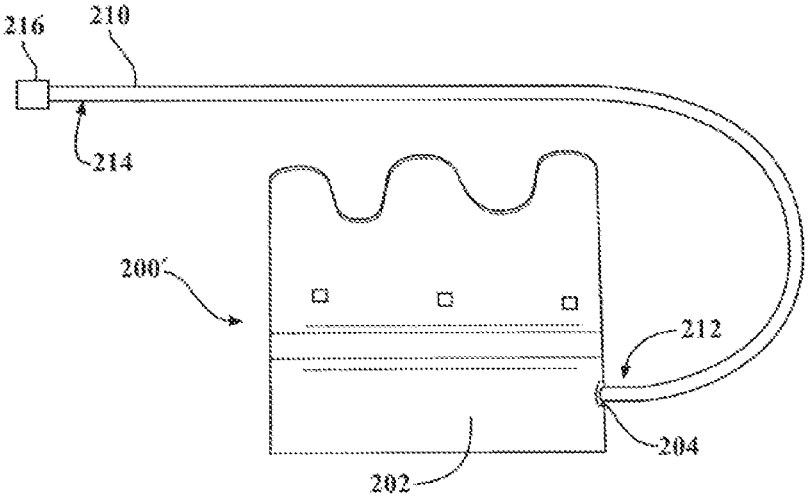

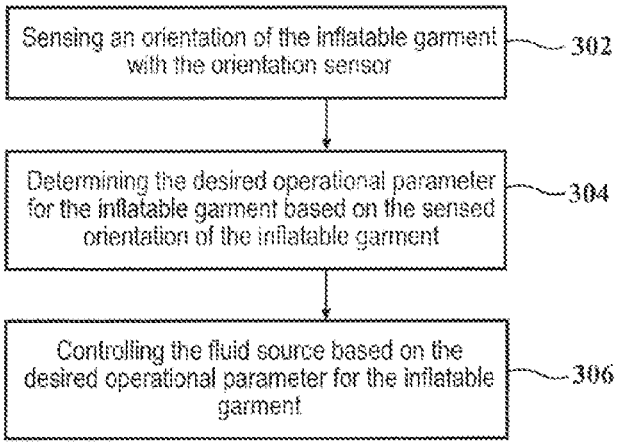
FIG. 10
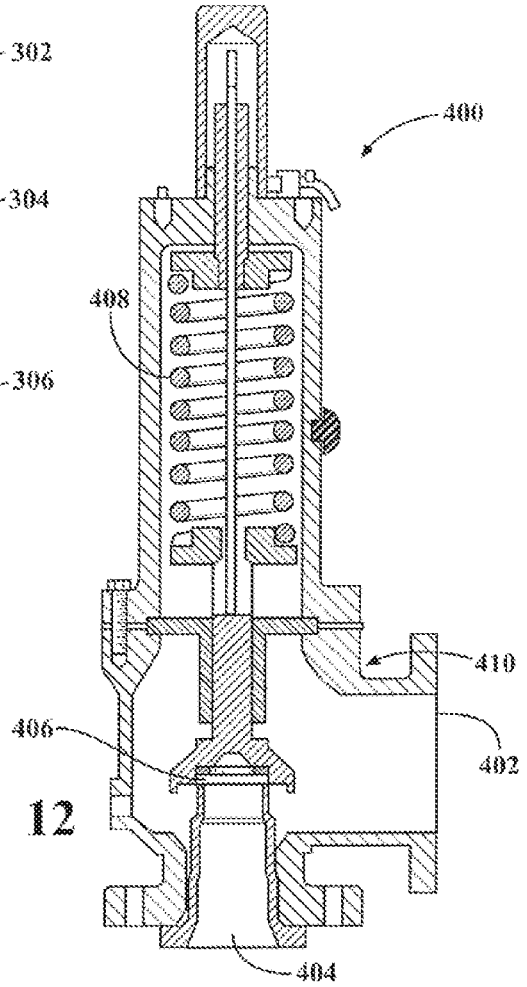
FIG. 12
FIG. 11
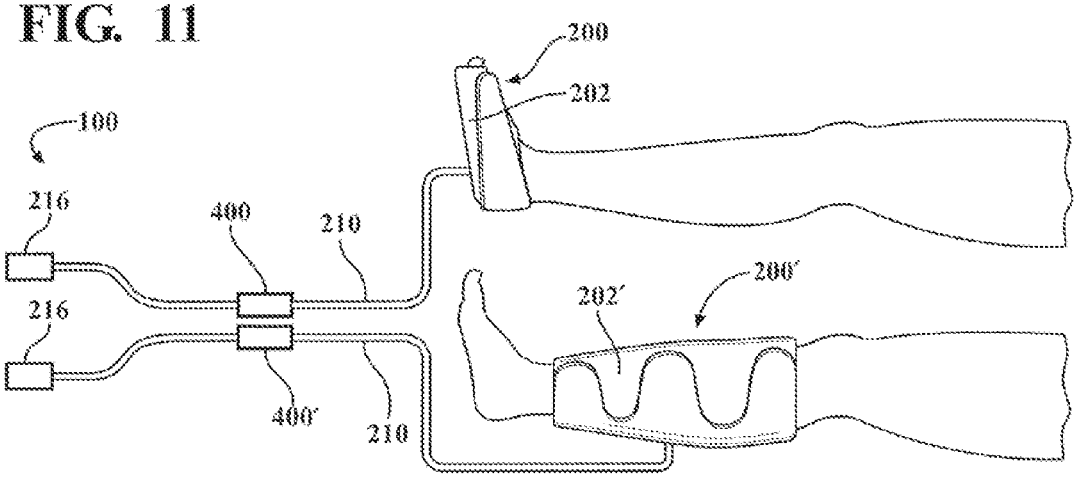

FIG. 23B
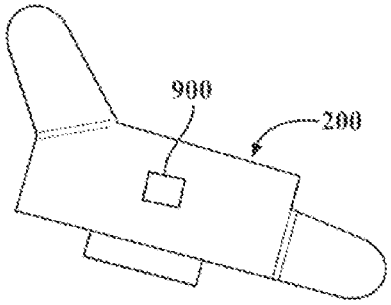
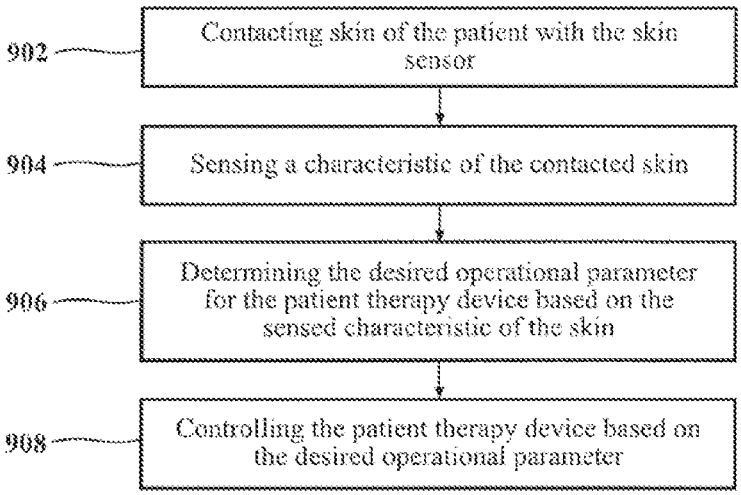
FIG. 24

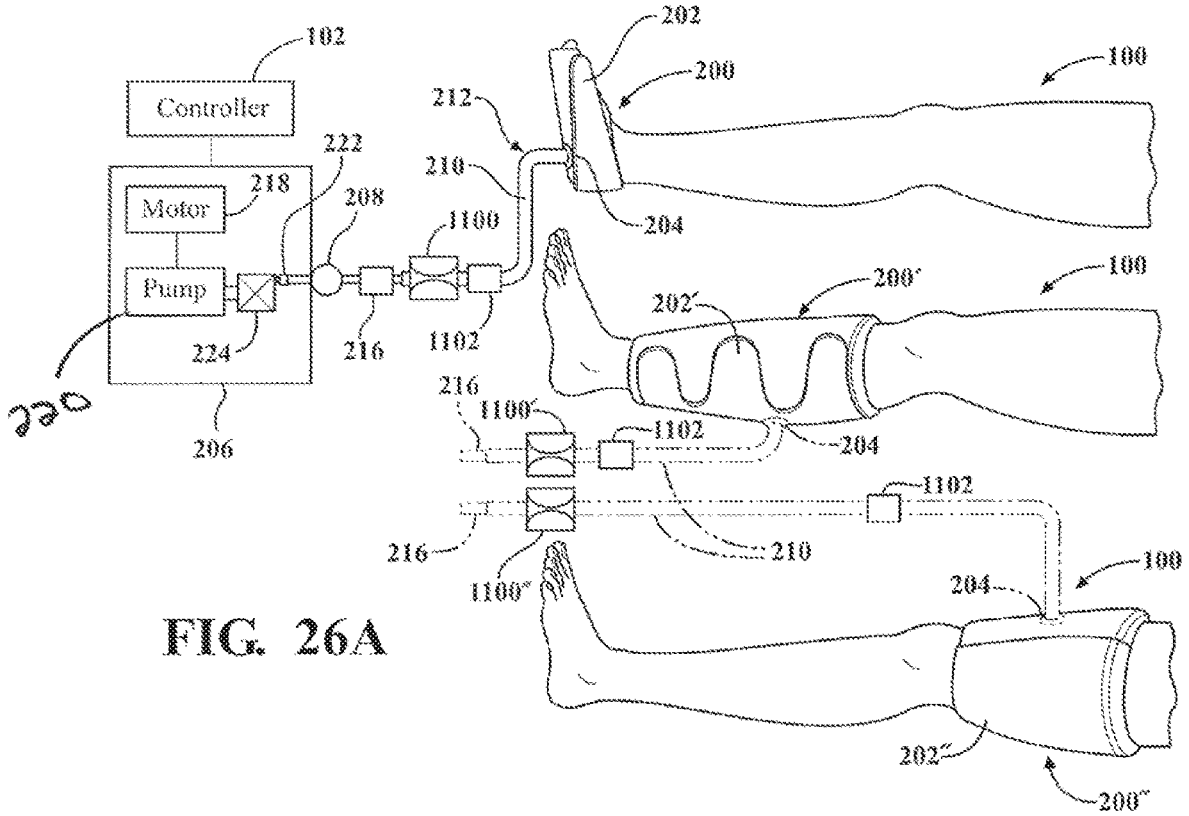
FIG. 26A
FIG. 26B
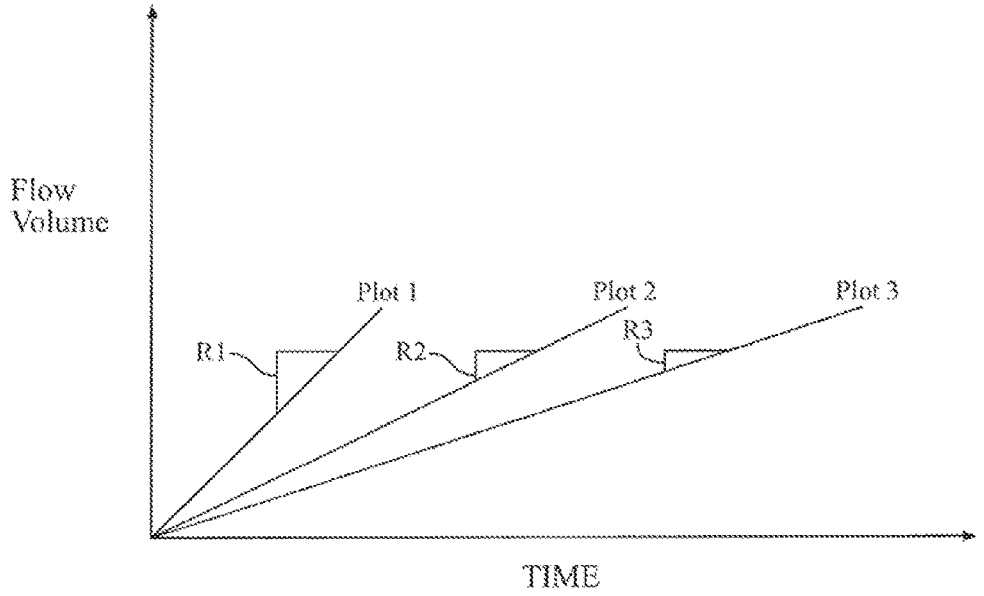

SYSTEMS AND METHODS FOR OPERATING PATIENT THERAPY DEVICES

RELATED APPLICATIONS

This application claims the benefit of and priority to U.S. provisional patent application No. 62/269,748, filed on Dec. 18, 2015, the entire contents and disclosure of which are hereby incorporated by reference.

BACKGROUND

Patient therapy devices deliver therapy to patients in a health care setting. Patient therapy devices comprise inflatable garments, electrical stimulation devices, patient warming devices, ultrasound therapy devices, and other devices designed to provide therapy to patients. Conventional patient therapy devices require a user to manually select desired operational parameters for the patient therapy device. Occasionally, a caregiver may select an operational parameter that is not compatible with the patient therapy device. Alternatively, the caregiver may select a desired operational parameter that is not ideally suited to deliver optimal therapy to the portion of patient that the therapy device is coupled to.

A patient therapy device designed to overcome one or more of the aforementioned challenges is desired.

BRIEF DESCRIPTION OF THE DRAWINGS

FIG. 3 is a schematic view of an inflation system for patient therapy devices.

FIG. 4 is a perspective and schematic view of an inflatable garment.

FIG. 10 is a flow diagram of a method of using a detection system that comprises an orientation sensor.

FIG. 11 is a schematic view of a detection system that utilizes a pressure-relief valve.

FIG. 12 is a cross-sectional view of an exemplary pressure-relief valve.

FIGS. 23A and 23B are perspective views of inflatable garments including skin sensors.

FIG. 24 is a flow diagram for a method of using a detection system that comprises a skin sensor.

FIG. 26A is a schematic view of an inflation system for patient therapy devices that includes flow sensors.

FIG. 26B is an exemplary flow rate graph that displays the flow rate of inflation for various inflatable garments.

DETAILED DESCRIPTION

Figure 1:
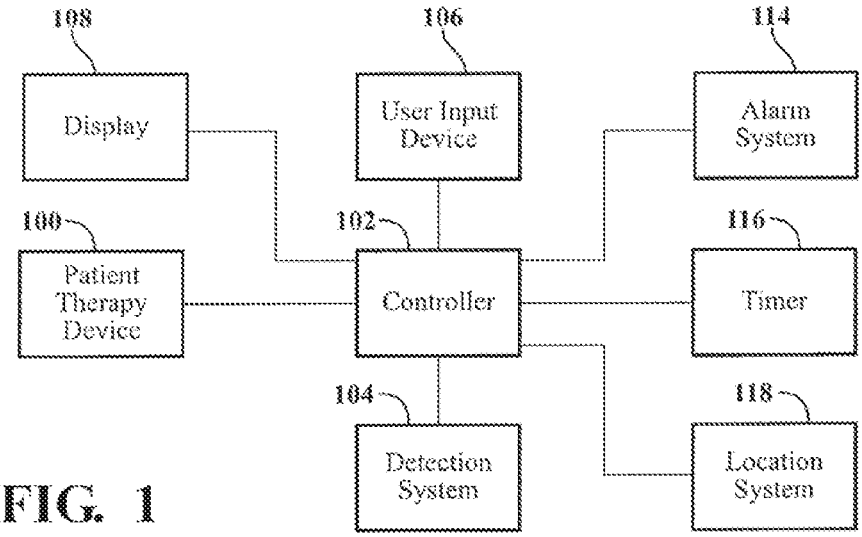
FIG. 1 is a schematic view of a system used to detect and control a patient therapy device.

Referring to FIG. 1, a patient therapy device 100 is configured to deliver therapy to a patient. The patient therapy device 100 may be coupled to a controller 102 that is configured to control the operational parameters of the patient therapy device 100 based on an input signal.

The patient therapy device 100 should be generally understood to be any device capable of providing therapy to the patient. In one embodiment, the patient therapy device 100 is configured to provide therapy to a part of the patient's body. The type of therapy that the patient therapy device 100 can provide is not particularly limited, and may include, without limitation, turning therapy, compression therapy, ultrasound therapy, massage therapy, percussion therapy, cooling therapy, heating therapy, vibration therapy, electrical stimulation therapy, and so forth. Thus, without limitation, the patient therapy device 100 may be a patient heating device, a patient cooling device, a patient turning device, a compression therapy device, a massage device, a percussion therapy device, a vibration therapy device, an ultrasound device, or an electrical stimulation device.

In certain embodiments, the patient therapy device 100 comprises an inflatable apparatus. The inflatable apparatus should be understood as any apparatus capable of being inflated with a fluid. For example, the inflatable apparatus may be selected from the group comprising an inflatable mattress, a mattress topper, an inflatable garment, a turn-assist bladder, and a chest-wall oscillation device.

The controller 102 is provided to control operation of the patient therapy device 100 as shown. The controller 102 comprises one or more microprocessors for processing instructions or for processing an algorithm stored in memory to control operation of the patient therapy device 100. Additionally or alternatively, the controller 102 may comprise one or more microcontrollers, field programmable gate arrays, systems on a chip, discrete circuitry, and/or other suitable hardware, software, or firmware that is capable of carrying out the functions described herein. The controller 102 may be a component of the patient therapy device 100, or may be remotely-located from the patient device 100. In one configuration, the controller 102 is mounted on the patient therapy device 100 itself. The controller 102 may communicate with the patient therapy device 100 via wired or wireless connections. In some configurations, the controller 102 may additionally supply power to the patient therapy device 100. Power may be supplied by the controller 102 with a battery power supply or an external power source.

The controller 102 may be electronically coupled directly to the patient therapy device 100 itself, or may be coupled to a sub-system that affects the operational parameters of the patient therapy device 100. The controller 102 generates and transmits an output signal to control the patient therapy device 100, or the sub-system. Thus, depending on the configuration of the patient therapy device 100, the controller 102 may transmit an output signal that controls the operation of one or more pumps, valves, circuits, motors and other devices that affect the operational parameters of the patient therapy device 100.

The controller 102 may be coupled to a detection system 104 that is configured to detect one or more characteristics of the patient therapy device 100. For example, the detection system 104 may be operable to detect the type of therapy that the patient therapy device 100 is configured to provide, the portion of the patient P to which the patient therapy device 100 is configured to provide therapy, the make, model, usage, or any other characteristic of the patient therapy device 100. For example, the detection system 104 may detect whether the patient therapy device 100 is a compression therapy device or an electrical stimulation device. As another example, the detection system 104 may detect whether the patient therapy device 100 is configured to provide therapy to the foot of the patient or the calf of the patient (especially for patient therapy devices 100 that are configured to engage a specific portion of the patient's body.) Based on the one or more characteristics of the patient therapy device 100 detected by the detection system 104, the detection system 104 provides an input signal to the controller 102. The type of detection system 104 is not particularly limited, but exemplary detection systems will be described below.

In addition, the controller 102 may be coupled to a user input device 106. The caregiver or other user may actuate the user input device 106 to transmit a corresponding user input signal to the controller 102. The controller 102, based on the user input signal received, may determine the desired operational parameter for the patient therapy device 100. Furthermore, as described above, the controller 102 may transmit an output signal to control the patient therapy device 100 in accordance with the desired operational parameter.

The controller 102 may be coupled to a display 108, and be configured to display the one or more characteristics of the patient therapy device 100 that are detected by the detection system 104. This allows the caregiver to easily identify the characteristics of the patient therapy device 100 detected by the detection system 104. For example, the detection system 104 may be configured to display the type of the patient therapy device 100 and/or the portion of the patient P to which the patient therapy device 100 is configured to provide therapy. The display 108 may also be configured to indicate current functionality of the patient therapy device 100, such as whether the patient therapy device 100 is currently in use, for how long, and/or when therapy being provided by the patient therapy device 100 is to stop or repeat for another cycle. The display 108 may comprise indicia such as text, graphics, etc. to indicate the one or more characteristics of the patient therapy device 100 and/or the current functionality.

The display 108 can be located anywhere that is suitable to indicate information to the caregiver. For example, the display 108 may be located remote from the patient's location, such as on a portable electronic device, nurse's station, or other location. For example, the patient therapy device 100 itself may comprise the display 108. The display 108 may be an LCD, LED, or other type of display. Alternatively, the controller 102 may be coupled to a speaker and/or a light emitting device that designate the operational parameter and/or the current functionality of the patient therapy device 100.

Based on the input signal received from the detection system 104, the controller 102 may determine a desired operational parameter for the patient therapy device 100. The controller 102, based on the desired operational parameter, controls the operation of the patient therapy device 100 accordingly. The desired operational parameter relates to one or more parameters of the therapy provided to the patient by the patient therapy device 100. For example, the desired operational parameter may relate to timing-related aspects of the therapy provided by the patient therapy device 100, such as the duration of therapy, whether the therapy is delivered in cycles, and if so, the duration of time of those cycles, and/or the duration of time in between cycles. Alternatively, the desired operational parameter may relate to therapy-specific aspects of the therapy delivered by the patient therapy device 100, such as for the inflatable apparatus, the maximum inflation pressure, the pressure gradient, the inflation time, and the deflation time.

The desired operational parameter may comprise a predetermined set of operational parameters. Thus, the controller 102 may determine, based on the input signal provided by the detection system 104 that a first set of operational parameters should be used to control the patient therapy device 100. The number of predetermined sets of operational parameters are not particularly limited, and may comprise a second set, a third set, and a fourth set of operational parameters, etc., with each set of operational parameters corresponding to a different type of patient therapy device 100.

The controller 102 may determine the desired operational parameters in any suitable manner, including by utilizing a look-up table, or by utilizing an algorithm, each enabling the controller 102 to determine what operational parameters are suitable based on the characteristics of the patient therapy device 100 as determined by the input signal provided by the detection system 104.

The controller 102 may be further configured to display the desired operational parameters on the display 108. For example, the controller 102 may be configured to have the display 108 indicate the maximum inflation pressure, the frequency of therapy cycles, etc.

In certain embodiments, the controller 102 may be coupled to an alarm system 114. The controller 102 may be programmed to identify certain pre-determined alarm conditions that arise during the course of delivering therapy to the patient. The controller 102 may be configured to activate the alarm system 114 based on one or more input signals received from the detection system 104, or other system. When activated, the alarm system 114 notifies the caregiver of the concerning circumstances. For example, if the controller 102 determines that the patient has moved from a lying-down position to a sitting-up position and/or from a sitting-up position to a lying-down position, the controller 102 may send an output signal to the alarm system 114 to cause the alarm system 114 to notify the caregiver of the change of position. The alarm system 114 may comprise an audible alarm, a visual alarm, a tactile alarm, or combinations thereof. By notifying the caregiver with the alarm system 114, the caregiver can take remedial action to eliminate the additional risk, such as stopping the delivery of therapy, removing the patient therapy device 100 from the patient, or changing one or more operational parameters of the patient therapy device 100.

In certain embodiments, the controller 102 is coupled to a timer 116. The timer 116 is configured to determine the duration of time that elapses during operation of the patient therapy device 100. For example, the timer 116 may be configured to measure the duration of one or more therapy cycles, the total duration of therapy, the duration that the patient therapy device 100 contacts the patient, or any other duration that relates to the operation or usage of the patient therapy device 100.

In other embodiments, the controller 102 may be coupled to a locating system 118. The locating system 118 is configured to generate a location input signal based on a location of the patient therapy device 100. Based on this location input signal, the controller 102 may determine the desired operational parameter for the patient therapy device 100.

Generally, the location of the patient therapy device 100 may provide valuable information as to the desired operational parameters for the patient therapy device 100. For example, if the patient therapy device 100 is placed adjacent to the foot of the patient, there are operational parameters that can be optimized to deliver therapy to the patient's foot. Similarly, if the patient therapy device 100 is placed adjacent to the arm of the patient, the operational parameters can be optimized to deliver therapy to the patient's arm. Thus, by determining the location of the patient therapy device 100, the controller 102 can optimize the therapy that is delivered to the patient.

The locating system 118 may utilize any combination of different locating technologies in order to determine the location of the patient therapy device 100. The type of locating system 118 is not particularly limited, and may comprise an electromagnetic locating system, such as a near-field locating system, a magnetic locating system, an electrical locating system, such as a capacitive locating system, an optical locating system, a thermal locating system, a weight locating system, or combinations thereof. Exemplary locating systems are described in detail below, but it should be appreciated that any suitable locating system 118 that is capable of providing a location input signal to the controller 102 may be suitable for the locating system 118.

The locating system 118 may be positioned in any suitable manner that allows the locating system 118 to determine the location of the patient therapy device 100. For example, the locating system 118 may be coupled to a patient support apparatus, as described below. Alternatively, the locating system 118 may be mounted on a wall or ceiling adjacent to an expected location of the patient. As will be appreciated, the position of the locating system 118 should be selected based on the type of locating system 118 that is utilized. Thus, if the locating system 118 is an optical locating system, the locating system 118 should be positioned in a manner that enables optimal field of view.

Figure 2:
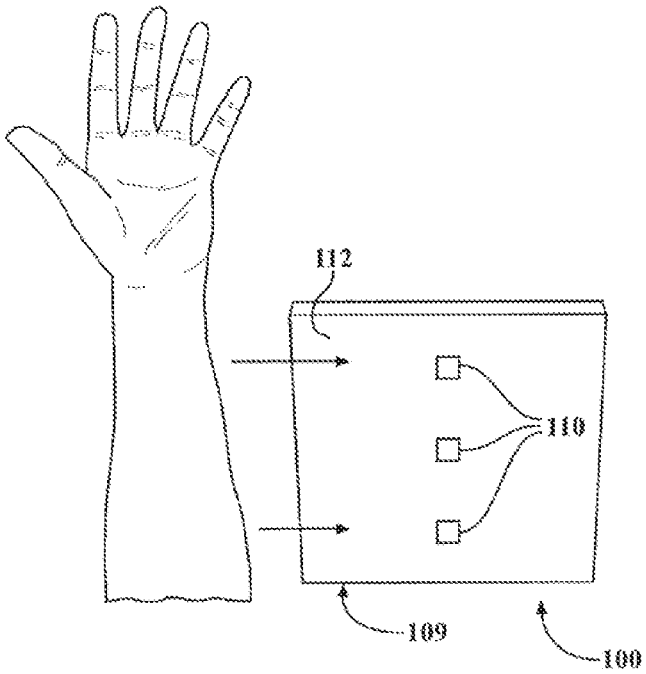
FIG. 2 is a perspective view of a patient therapy device including patient sensors.

Referring to FIG. 2, the patient therapy device 100 is a patient stimulation device 109 comprising one or more patient sensors 110. Although three patient sensors 110 are shown, there may be more or fewer patient sensors 110 in other embodiments. Each of the patient sensors 110 is configured to detect whether the patient stimulation device 109 is positioned adjacent to a portion of the patient's body. The patient sensors 110 may be configured to sense one or more parameters of the patient and provide patient indicator input signals to the controller 102 based on whether the patient's body has been sensed. While the type of sensing is not particularly limited, the patient sensors 110 may comprise force sensors, capacitive sensors, temperature sensors, or combinations thereof. The patient sensor 110 may be communicate with the controller 102 in any suitable manner, such as wirelessly or through physical communication lines.

For example, if the patient sensors 110 comprise a temperature sensor that senses a temperature above a predetermined threshold, such as 95° F., the controller 102 can determine that the patient stimulation device 109 is positioned adjacent to the patient's body. However, if the patient sensor 110 senses a temperature of only 65° F., the controller 102 can determine that the patient stimulation device 109 is not positioned adjacent to the patient's body. As another example, if the patient sensor 110 comprises a capacitive sensor that detects a capacitance above a predetermined threshold, the controller 102 may determine that the patient stimulation device 109 is positioned adjacent to the patient's body.

The patient sensors 110 may be arranged on the patient stimulation device 109 in any suitable manner that allows the patient sensors 110 to determine whether the patient stimulation device 109 is positioned adjacent to the patient P. For example, the patient sensors 110 may be arranged on an inner surface 112 of the patient stimulation device 109 such that the patient sensors 110 contact the skin of the patient P when the patient stimulation device 109 is in a use position. In the embodiment shown, the patient sensors 110 are fixed to the patient stimulation device 109 so that the patient sensors 110 are located in areas of the patient stimulation device 109 that are most likely to be in direct contact with the patient's skin. The patient sensors 110 may be coupled to the patient stimulation device 109 using an adhesive, ultrasonic welding, thermal welding, and the like. However, the patient sensors 110 do not necessarily need to be positioned to contact the skin of the patient P to determine whether the patient stimulation device 109 is in a use position. Furthermore, it should be appreciated that the patient sensors 110 may be utilized with any type of patient therapy device 100, including, but not limited to, inflatable garments, patient warming devices, patient cooling devices, etc.

Referring now to FIG. 3, in one embodiment, the patient therapy devices 100 comprise inflatable garments 200, 200', 200". Each of the inflatable garments 200, 200', 200" comprises a bladder 202, 202', 202". The bladders 202, 202', 202" are capable of inflating and deflating based on fluid transfer from a fluid source 206. The inflatable garments 200, 200', 200" may further comprise hook and loop fasteners, for holding the inflatable garments 200, 200', 200" on the limb of the patient P. It is also contemplated that each of the inflatable garments 200, 200', 200" may comprise multiple bladders, optionally in fluid communication with one another. The bladders 202, 202', 202" may each comprise a garment port 204. The garment port 204 may enable the transfer of fluid from the fluid source 206 to the bladders 202, 202', 202".

As is further illustrated in FIG. 3, the fluid source 206 comprises a motor 218 and a pump 220, with the motor 218 controlling the operation of the pump 220. The controller 102 may transmit an output signal to the motor 218 and/or pump 220 to control the fluid source 206. The design and configuration of the motor 218 and/or pump 220 is not particularly limited. Alternatively, the fluid source 206 may comprise a compressor, a fluid port on a headwall or a patient support apparatus, or any other suitable source of fluid. In embodiments where the fluid source comprises the fluid port on the headwall, the fluid port on the headwall may be coupled to remote fluid source equipment, such as one or more pump units or compressor units located in a maintenance room, and a series of pipes or other types of conduits that are routed from the source equipment to various gas outlets located throughout the healthcare facility. In summary, the fluid source 206 should be understood as including any type of device or equipment that is capable of producing pressurized fluid to the inflatable garments 200, 200', 200". Any type of fluid may be provided by the fluid source 206, including a liquid or gas, such as air or water.

The fluid source 206 may be regulated such that the parameters of the fluid supplied by the fluid source 206 may be controlled. The manner in which the fluid source 206 is regulated is not particularly limited. For example, the fluid source 206 may be coupled to a suitable pressure regulator to reduce the pressure supplied by the fluid source 206 to a pressure that is useable for the inflatable garments 200, 200', 200". The pressure regulator may be positioned in any suitable location along the fluid flow path so long as the pressure regulator controls the parameters of the fluid before the fluid reaches the inflatable garment 200, 200', 200". Of course, any type of regulator may be used.

The inflatable garments 200, 200', 200" comprise an inflatable foot garment, an inflatable calf garment, and an inflatable thigh garment, respectively. For simplicity, the configuration and operation of only one of the inflatable garments 200, 200', 200" will be described further below, since the configuration and operation of each is similar.

During use of the inflatable garment 200, the inflatable garment 200 is coupled to the fluid source 206. The fluid source 206 is configured to provide fluid, such as air or water, to the inflatable garment 200 to inflate the bladder 202. The fluid source 206 may be coupled to the controller 102, and the controller 102 may transmit the output signal to the fluid source 206 in a manner that controls the operation of the fluid source 206. The fluid source 206 may be controlled by the controller 102 in any suitable manner, such as wirelessly or through physical communication lines.

The fluid source 206 further comprises a source interface 208 that is in fluid communication with the fluid source 206. In certain embodiments, the source interface 208 comprises multiple ports in embodiments where the inflatable garment 200 comprises multiple bladders 202.

Referring to FIG. 4, the inflatable garment 200' may also comprise a fluid supply tube 210 that is coupled to the garment port 204 of the bladder 202'. Although the fluid supply tube 210 is illustrated as having a single conduit through which the bladder 202' is inflated and deflated, it is also contemplated that the fluid supply tube 210 may comprise multiple conduits in embodiments where the inflatable garment 200' comprises multiple bladders, or when the fluid supply tube 210 is used for inflating and/or deflating a plurality of inflatable garments 200'. In such embodiments, the plurality of conduits may be coupled together to form a ribbon of conduits.

The fluid supply tube 210 may have a first end 212 and a second end 214. The first end 212 of the fluid supply tube 210 may be coupled to the garment port 204 and the second end 214 of the fluid supply tube 210 may be coupled to a connector 216.

The connector 216 is configured to engage the source interface 208 of the fluid source 206 to establish fluid communication between the fluid supply tube 210 and the fluid source 206. For example, the connector 216 may comprise a male insert and the source interface 208 may comprise a cooperating female receptacle for receiving the male insert so as to form a coupled state. In certain embodiments, the male insert or female receptacle may comprise a retention member for ensuring that a fluid tight seal is formed when the connector 216 engages the source interface 208.

Referring back to FIG. 3, when the connector 216 is coupled to the source interface 208, all of the bladder 202, the garment port 204, the fluid source 206, the source interface 208, the fluid supply tube 210, and the connector 216 cooperate to define a fluid flow path. Of course, the fluid flow path may also be defined as including less than all of these segments. Thus, in one embodiment, the fluid flow path may be defined by the bladder 202, the garment part 204, the fluid supply tube 210, and the connector 216.

A pressure sensor 222 may be provided in certain embodiments. The pressure sensor 222 is configured to provide a pressure input signal to the controller 102 that is indicative of a pressure in the fluid flow path. More specifically, the pressure sensor 222 may provide a pressure input signal to the controller 102, and the controller 102 is configured to determine the pressure in the fluid flow path based on the pressure input signal. In certain embodiments, the pressure within the fluid flow path correlates to the pressure in the bladder 202. It should be appreciated that the configuration and location of the pressure sensor 222 is not particularly limited, as any suitable pressure sensor design may be utilized. Furthermore, two or more pressure sensors 222 may be employed, each located at different points in the fluid flow path. The pressure sensor 222 may be communicate with the controller 102 in any suitable manner, such as wirelessly or through physical communication lines.

The pressure sensor 222 may take many forms. In one exemplary embodiment, the pressure sensor 222 comprises a piezoelectric sensor. The piezoelectric sensor 222 comprise a piezoelectric element, such as quartz. The piezoelectric element of the piezoelectric sensor generates a charge when pressure is applied, and the controller 102 may recognize the charge as corresponding to a pressure through the use of a suitable look-up table or algorithm.

The fluid source 206 may further comprise a valve 224 situated along the fluid flow path within the fluid source 206 to control the fluid flow through and along the fluid flow path. The valve 224 may be alternatively situated in the bladder 202, the fluid supply tube 210, or the connector 216. Although FIG. 3 illustrates only one valve 224 coupled to the fluid flow path, it should be appreciated that the fluid source 206 may comprise any number of valves 224, each in fluid communication with the fluid supply tube 210.

The controller 102 may be coupled to the valve 224 to control the path of fluid flowing through the valve 224. For example, the valve 224 may be electronically-actuated based on an output signal that is transmitted from the controller 102 such that the configuration of the valve 224 moves into one of three possible valve positions.

In certain embodiments, the valve 224 comprises a three-way valve 224. The three-way valve 224 comprises three positions: an inflation position, a closed position, and a deflation position. The first position of the three-way valve 224 may define an inflation position. Once the three-way valve 224 moves to the inflation position, the controller 102 may activate the fluid source 206 to inflate the bladder 202 through the fluid flow path. The inflation position of the three-way valve 224 allows fluid communication between the fluid source 206 and the bladder 202 of the inflatable garment 200. The second position of the three-way valve 224 comprises a deflation position. Once the three-way valve 224 moves to the deflation position, the three-way valve 224 prevents fluid communication from the fluid source 206 to the bladder 202 of the inflatable garment 200, but does allow fluid communication between the bladder 202 and an ambient environment. Thus, after the inflatable garment 200 has been inflated, and the valve 224 subsequently assumes the deflation position, the pressurized fluid within the bladder 202 leaves the bladder 202 through the valve 224 and into the ambient environment. The third position of the three-way valve 224 comprises a closed position. The closed position of the three-way valve 224 does not allow fluid communication between the bladder 202 and the ambient environment, and does not allow fluid communication between the fluid source 206 and the bladder 202. In other words, when the three-way valve 224 is in the closed position, the fluid communication between the fluid source 206 and the connector 216 is prevented by the valve 224. Accordingly, the bladder 202 of the inflatable garment 200 remains in an inflated configuration when the valve 224 is placed in the closed position after initial inflation of the bladder 202.

As described above, the controller 102 may transmit an output signal that causes the valve 224 to change position based on the pressure input signal received from the pressure sensor 222. For example, if the pressure input signal from the pressure sensor 222 indicates that the pressure within the fluid flow path has reached a desired level, the controller 102 may transmit the output signal which causes the valve 224 to change to the closed position. In addition, the controller 102 may additionally transmit the output signal to the fluid source 206 to stop fluid flow, i.e., transmit a stop signal to the pump 220 and/or the motor 218. Of course, it should be appreciated that the pressure within the fluid flow path can be controlled in any number of ways, using various control algorithms.

Figure 5:
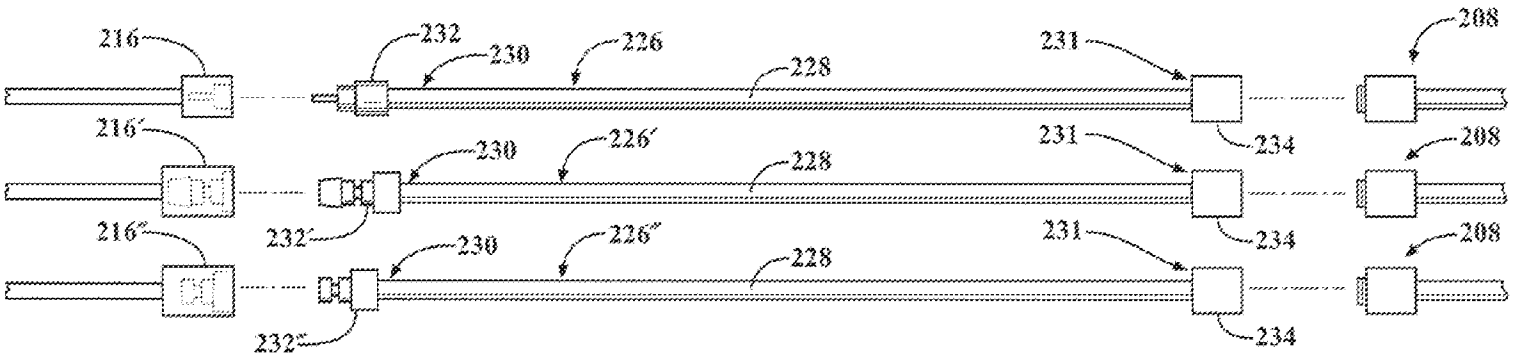
FIG. 5 is a perspective view of an adaptor tube set.

Referring now to FIG. 5, in certain embodiments, adaptor tube sets 226, 226', 226" may be provided in conjunction with inflatable garments having various styles of connectors 216, 216', 216" to be coupled to the source interface 208. Thus, each adaptor tube set 226, 226', 226" is configured to fluidly couple to the connectors 216, 216', 216" with the source interface 208 in the situation where inflatable garments comprise different styles of connectors 216, 216', 216".

Each adaptor tube set 226, 226', 226" comprises an adaptor conduit 228 having a first end 230 and a second end 231. The adaptor tube sets 226, 226', 226" further comprise adaptor couplers 232, 232', 232". The adaptor coupler 232 is configured specific to the design of the corresponding connector 216, 216', 216". Thus, in certain embodiments, each adaptor tube set 226, 226', 226" comprises respective adaptor couplers 232, 232', 232", which are configured to match the style of the connectors 216, 216', 216". The adaptor couplers 232, 232', 232" are coupled to the first end 230 of the adaptor conduits 228. The adaptor tube sets 226, 226', 226" further comprises a source coupler 234 coupled to the second end 231 of the adaptor conduits 228. The source coupler 234 may be configured to engage the source interface 208 to establish fluid communication between the adaptor conduit 228 and the fluid source 206.

Figure 6A:
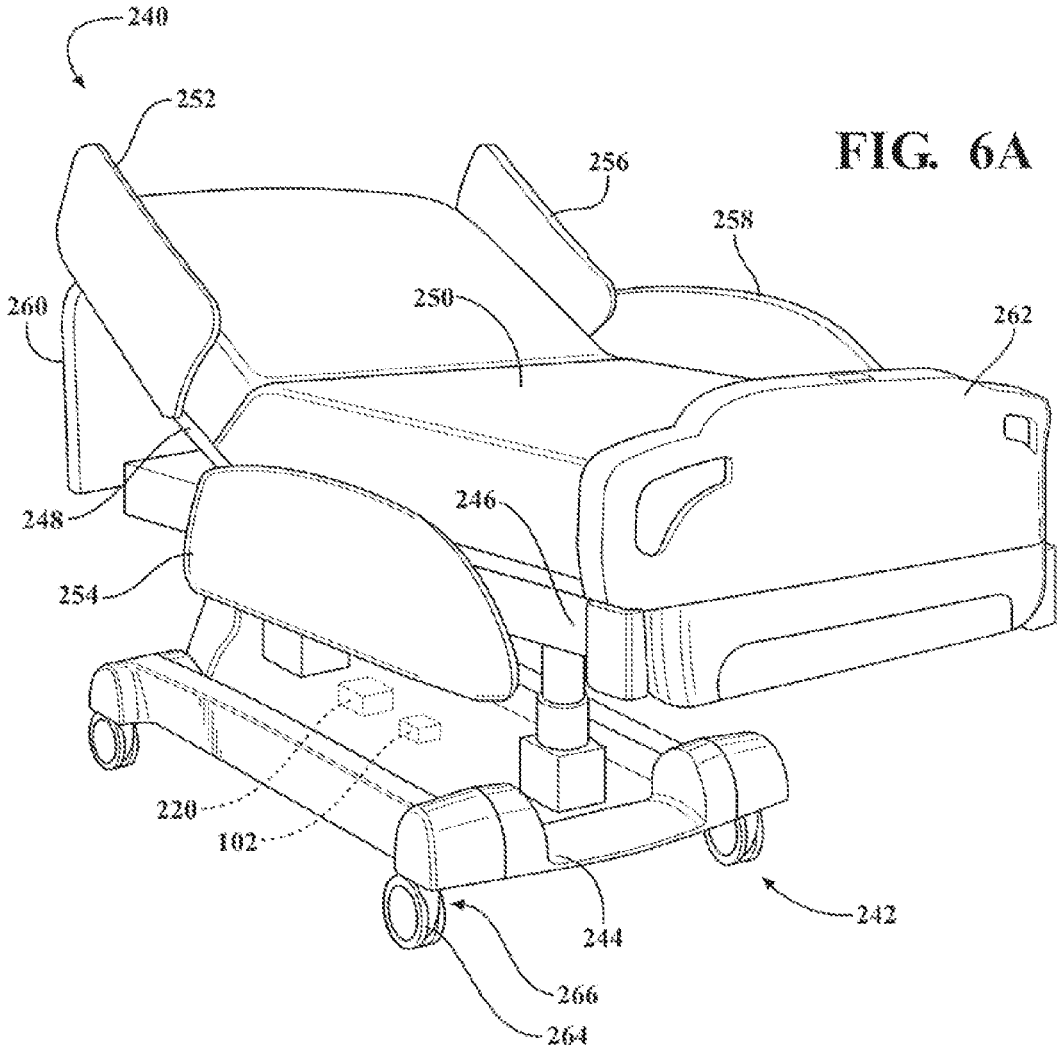
FIGS. 6A, 6B and 6C are perspective views of a patient support apparatus including various inflation systems.

Referring to FIG. 6A, in certain embodiments, the pump 220 is mounted to a frame of a patient support apparatus 240. An exemplary patient support apparatus 240 is shown for supporting the patient in a health care setting. The patient support apparatus 240 illustrated in FIG. 6A comprises a hospital bed. In other embodiments, however, the patient support apparatus 240 may comprise a stretcher, cot, table, wheelchair, or similar apparatus utilized in the care of the patient. A support structure 242 provides support for the patient. The support structure 242 illustrated in FIG. 6A comprises a base 244 and an intermediate frame 246. The intermediate frame 246 is spaced above the base 244. The support structure 242 also comprises a patient support deck 248 disposed on the intermediate frame 246. The patient support deck 248 comprises several sections, some of which are pivotable relative to the intermediate frame 246, such as a fowler section, a seat section, a thigh section, and a foot section. The patient support deck 248 provides a patient support surface 250, such as a mattress, upon which a patient can be supported.

Side rails 252, 254, 256, 258 are coupled to the intermediate frame 246 and thereby supported by the base 244. A first side rail 252 is positioned at a right head end of the intermediate frame 246. A second side rail 254 is positioned at a right foot end of the intermediate frame 246. A third side rail 256 is positioned at a left head end of the intermediate frame 246. A fourth side rail 258 is positioned at a left foot end of the intermediate frame 246.

If the patient support apparatus 240 is a stretcher or a cot, there may be fewer side rails. The side rails 252, 254, 256, 258 are movable between a raised position in which they block ingress and egress into and out of the patient support apparatus 240, and a lowered position in which they are not an obstacle to such ingress and egress. The side rails 252, 254, 256, 258 may also be movable to one or more intermediate positions between the raised position and the lowered position. In still other configurations, the patient support apparatus 240 may not include any side rails.

A headboard 260 and a footboard 262 are coupled to the intermediate frame 246. In other embodiments, when the headboard 260 and footboard 262 are included, the headboard 260 and footboard 262 may be coupled to other locations on the patient support apparatus 240, such as the base 244. In still other embodiments, the patient support apparatus 240 does not include the headboard 260 and/or the footboard 262.

Wheels 264 are coupled to the base 244 to facilitate transport over the floor surfaces. The wheels 264 are arranged in each of four quadrants of the base 244 adjacent to corners of the base 244. In the embodiment shown, the wheels 264 are caster wheels able to rotate and swivel relative to the support structure 242 during transport. Each of the wheels 264 forms part of a caster assembly 266. Each caster assembly 266 is mounted to the base 244. It should be understood that various configurations of the caster assemblies 266 are contemplated. In addition, in some embodiments, the wheels 264 are not caster wheels and may be non-steerable, steerable, non-powered, powered, or combinations thereof. Additional wheels are also contemplated. For example, the patient support apparatus 240 may comprise four non-powered, non-steerable wheels, along with one or more powered wheels.

Figure 6B:
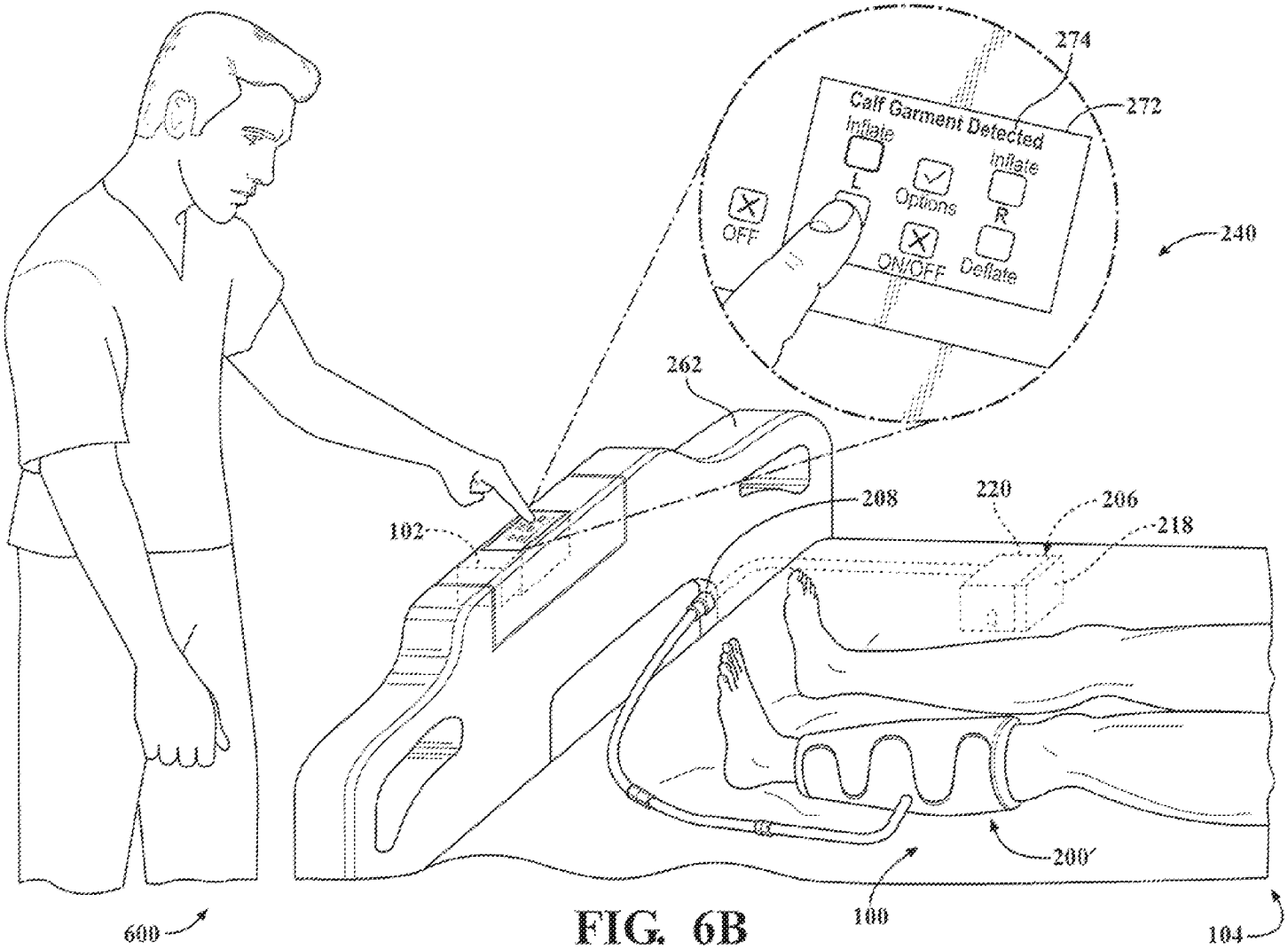
Figure 6C:
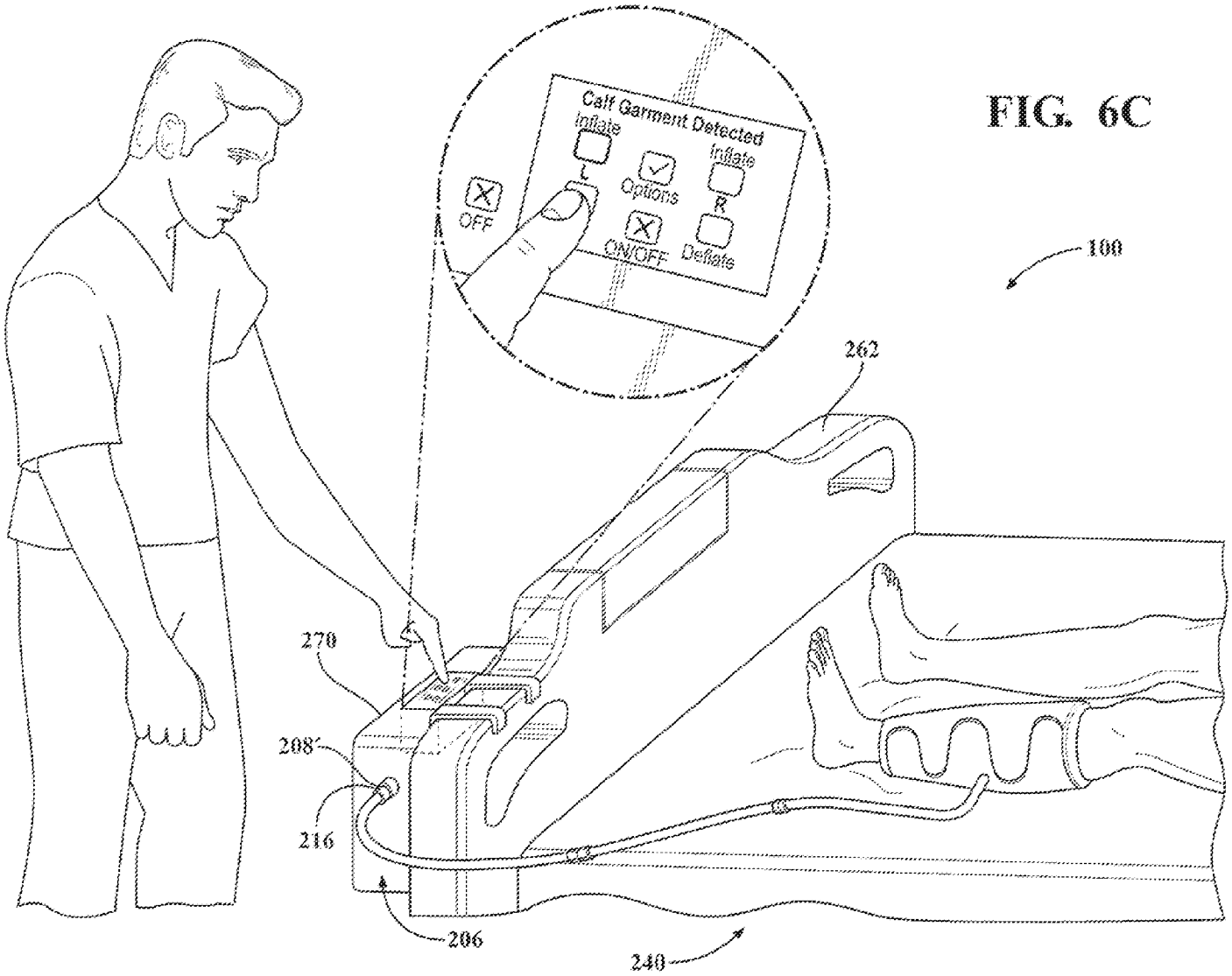

As shown in FIGS. 6B and 6C, the fluid source 206 and the source interface 208 may be integrated into various aspects of the patient support apparatus 240. For example, in FIG. 6B, the source interface 208 may be provided on the footboard 262 of the patient support apparatus 240, and the motor 218 and pump 220 may be integrated into the electrical system of the patient support apparatus 240, which in turn receives power either from a standard power outlet or an on-board battery system. Furthermore, in certain embodiments, the source interface 208 may be coupled to a fluid system of the patient support apparatus 240.

In certain embodiments, as shown in FIG. 6C, the fluid source 206 may be provided in a separate housing 270. The housing 270 may be portable. In this configuration, the portable housing 270 comprises a source interface 208'. This housing 270 may further be capable of being removably coupled to a portion of the patient support apparatus 240, such as being removably coupled to the footboard 262 of the patient support apparatus 240. In such an embodiment, the housing 270 may hang from the footboard 262, or the footboard 262 defines a cavity that allows insertion of the portable housing 270 into the footboard 262. In certain embodiments, the controller 102 and the fluid source 206 are mounted within the housing 270, such that the portable housing 270 is self-powered to operate its electrical and fluid components without connection to any external power sources.

As shown in FIG. 6C, the source interface 208' is provided as part of the portable housing 270. When the patient needs to exit the patient support apparatus 240, such as to go to the bathroom or to undergo physical therapy or other medical treatments or procedures, the portable housing 270 may be removed from the footboard 262 so that the therapy may continue while the patient is away from the patient support apparatus 240. The housing 270 may comprise suitable belts, straps, harnesses, or the like for the patient to carry the portable housing 270 while ambulatory.

Referring again to FIG. 6B, the controller 102 may provide data to a control system of the patient support apparatus 240. The patient support apparatus 240 may comprise on-board user input devices 272 and on-board displays 274. The controller 102 may be coupled to the on-board user input devices 272 and/or on-board displays 274 of the patient support apparatus 240. For example, the controller 102 may be configured such that commands entered on the on-board user input devices 272 relating to the operation of the fluid source 206 are coupled to the controller 102 through the control system of the patient support apparatus 240. Similarly, data sensed or otherwise generated by the controller 102 and/or the detection system 104 may be communicated through the control system of the patient support apparatus 240 to the on-board display 274 of the patient support apparatus 240.

During operation of the inflatable garment 200' shown in FIG. 6B, the controller 102 is configured to receive the input signal from the detection system 104. The detection system 104 is configured to detect one or more characteristics of the inflatable garment 200', such as the type of inflatable garment 200'. For example, the detection system 104 may provide an input signal to the controller 102 that indicates that the inflatable garment 200 detected is the inflatable foot garment, the inflatable calf garment, or the inflatable thigh garment.

Furthermore, based on the input signal received from the controller 102, the controller 102 may determine a desired operational parameter for the inflatable garment 200'. As described above, the desired operational parameter is not particularly limited, and may comprise a cycle frequency, an inflation rate, a deflation rate, a duration of inflation, a rest period between cycles, an alarm parameter, a target operating pressure, an inflation profile, a fluid destination, and combinations thereof.

For example, if the inflatable garment 200' coupled to the detection system 104 is a calf garment, and if it is desired to inflate the inflatable garment 200' according to a first operational parameter (e.g. inflate the bladder 202' to a single target pressure and maintain the pressure), the input signal received by the controller 102 would be used to configure the fluid source 206 for the fluid demands that must be satisfied. Because the input signal is indicative of the one or more characteristics of the inflatable garment 200' that is coupled to the fluid source 206, the controller 102 can determine the desired operational parameters based on those one or more characteristics. As a result, the controller 102 transmits an output signal that controls the fluid source 206, valve 224 or any other related components to deliver fluid to the inflatable garment 200' in accordance with the desired operational parameters (e.g. target pressure, fill rate) of the inflatable garment 200'. For example, in embodiments where the fluid source 206 comprises the pump 220, the speed of the pump 220 can be adjusted or selected accordingly based on the output signal received from the controller 102. If the inflatable garment 200' had different characteristics, the input signal provided to the controller 102 could be different; the controller 102 may determine different desired operational parameters in accordance with these different characteristics; and the controller 102 could transmit a different output signal to control the fluid source 206, valves 224 and other components in accordance with these different desired operational parameters. For example, if the controller 102 receives an input signal that indicates the type of inflatable garment 200' being used to deliver compression therapy to a patient is a calf garment, the controller 102 may determine that the desired operational parameter is an inflation pressure of approximately 40 mm Hg.

Further still, it is contemplated that the controller 102 may determine a combination of two or more desired operational parameters for the inflatable garment 200' based on the input signal received. For example, the controller 102 may determine both a desired inflation pressure and a cycle time for the inflatable garment 200', and control the fluid source 206 to exhibit the desired inflation pressure and the desired cycle time.

Once the controller 102 determines the desired operational parameters, the controller 102 may cooperate with the display 108 to prompt a caregiver to confirm the determined desired operational parameters for the inflatable garment 200'. Thus, continuing with the example above, the controller 102 may prompt the caregiver to confirm that the operational parameter of the inflation pressure of 40 mm Hg associated with operation of the inflatable garment 200' is appropriate. The controller 102 may further be configured to provide an indication to the caregiver, through the alarm system 114, that such confirmation has not yet been provided by the caregiver.

In addition to determining one or more desired operational parameters for the inflatable garment 200', the controller 102 may further determine the type of inflatable garment 200' based on the input signal received from the detection system 104. Based on the type of inflatable garment 200', the controller 102 may determine one or more desired operational parameters. Thus, in one embodiment, based on the input signal received from the detection system 104, the controller 102 may determine that the inflatable garment 200' is configured to be used with a patient's calf, and determine that the desired operational parameters based on the fact that the inflatable garment 200' is of a type that is configured to be used with a patient's calf.

Furthermore, the controller 102 may be configured to determine whether a leak is present in the inflatable garment 200'. These fault conditions may be that a leak has been detected in the fluid flow path (i.e., a leak is present in the bladder 202', the fluid supply tube 210, or the connector 216). By comparing the pressure input signal received from the pressure sensor 222 to an expected signal, the controller 102 may determine whether a leak is present. The methods for leak detection are not particularly limited, and may comprise comparing the actual inflation profile to a desired inflation profile, and/or comparing the actual inflation rate to the desired inflation rate. For example, based on the pressure input signal, the controller 102 may determine the actual pressure within the fluid flow path after a predetermined amount of time and compare the actual pressure with the expected pressure after a predetermined amount of time to detect a leak within the fluid flow path.

Figure 7A:
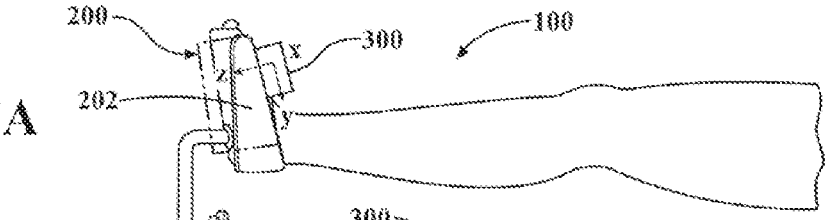
FIGS. 7A and 7B are side views of inflatable garments including orientation sensors.
Figure 7B:
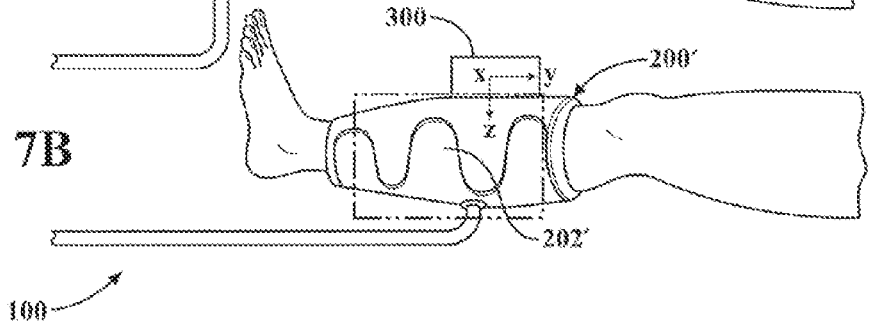

Referring to FIGS. 7A and 7B, in another embodiment, the detection system 104 comprises orientation sensors 300 coupled to the patient therapy devices 100. For instance, the orientation sensor 300 may be coupled to the inflatable garments 200, 200'. While the orientation sensor 300 configuration is described below with reference to the inflatable garments 200, 200', it should be noted that a similar configuration may be used with any type of patient therapy device 100.

During operation, the orientation sensor 300 is configured to sense an orientation of the inflatable garments 200, 200'. The orientation sensor 300 may generate an orientation input signal to the controller 102, and the controller 102, based on the input signal received from the orientation sensor 300, may determine an orientation of the inflatable garments 200, 200'. The controller 102 may further determine a desired operational parameter based on the determined orientation of the inflatable garments 200, 200'. Furthermore, the controller 102 may further determine a type of inflatable garment based on the orientation input signal received from the orientation sensors 300. The orientation sensor 300 may be communicate with the controller 102 in any suitable manner, such as wirelessly or through physical communication lines.

The controller 102 may be configured to determine the desired operational parameter based on an orientation input signal received from the orientation sensor 300. The orientation sensor 300 is configured to generate an orientation input signal that is indicative of the orientation of the inflatable garment 200, 200' to which the orientation sensor 300 is coupled. The orientation sensor 300 may be coupled to the inflatable garments 200, 200' in any suitable manner. In FIGS. 7A and 7B, the orientation sensors 300 are illustrated as being coupled to the bladders 202, 202' of the inflatable garments 200, 200'. In certain embodiments, the orientation sensors 300 are removably coupled to the inflatable garments 200, 200' by attachment with a hook and loop system or through other forms of mechanical attachment. Alternatively, the orientation sensors 300 may be permanently attached to the inflatable garments 200, 200' with adhesive, ultrasonic welding, or other suitable attachment.

The orientation sensor 300 is particularly useful in configurations where, during use, the inflatable garment 200, 200' or other patient therapy device 100 can be used in one or more positions on the body. The orientation sensor 300 enables the controller 102 to determine whether the inflatable garment 200, 200' actually engages the patient's foot or the patient's calf. Because different portions of the patient's body are shaped differently, the orientation sensor 300 provides different orientation input signals depending on which portion of the patient's body the inflatable garments 200, 200' are applied. This is useful because the desired operational parameters for the inflatable garments 200, 200' differ depending on the portion of the patient's body to which the inflatable garments 200, 200' are applied.

In FIG. 7A, the orientation sensor 300 provides an orientation input signal that is indicative that the inflatable garment 200 is oriented in the following manner: the z-axis measures 30 degrees, the y-axis measures 30 degrees, and the x-axis measures 0 degrees. The controller 102, based on this orientation input signal, determines that the orientation sensor 300 is coupled to the inflatable garment 200, the inflatable foot garment. The controller 102, further based on this orientation input signal, determines a desired operational parameter for the inflatable garment 200. The controller 102 then transmits an output signal to control the fluid source 206 in accordance with the determined desired operational parameters for the inflatable garment 200. For example, based on the orientation input signal, the controller 102 transmits an output signal to control the fluid source 206 such that the pressure within the fluid flow path is maintained at approximately 130 mm Hg for the inflatable garment 200. This can be accomplished by receiving a signal from the orientation sensor 300, and comparing the orientation to a look-up table in the controller 102 that correlates the measured orientation to various operational parameters. Of course, accounting for variations of the different patients' body shape and size, the look-up table may comprise certain ranges of orientation for each axis, and control the operational parameters for the inflatable garments 200, 200' based on which range the measured orientation fell within.

In FIG. 7B, the orientation sensor 300 provides an orientation input signal that is indicative that the inflatable garment 200' is oriented in the following manner: the z-axis measures 0 degrees, the y-axis measures 0 degrees, and the x-axis measures 0 degrees (with the x-axis into the page). The controller 102, based on this input signal, determines that the orientation sensor 300 is coupled to the inflatable garment 200', the inflatable calf garment. The controller 102, further based on this orientation input signal, determines a desired operational parameter for the inflatable garment 200'. For example, the controller 102 transmits an output signal to control the fluid source 206 such that the pressure within the fluid flow path is maintained at approximately 40 mm Hg for inflatable garment 200'.

As will be readily understood, the orientation sensors 300 of FIGS. 7A and 7B are oriented differently relative to gravity. As such, the orientation sensors 300 each provide different orientation input signals to the controller 102. Based on these different orientation input signals, the controller 102 can determine that the inflatable garments 200, 200' are positioned adjacent to different portions of the patient's body. Because the controller 102 can determine that the inflatable garments 200, 200' are positioned adjacent to different portions of the patient's body, the controller 102 can determine desired operational parameters that are suitable for delivering therapy to that specific portion of the patient's body.

Any suitable design for the orientation sensor 300 is contemplated for use in the detection system 104 and methods described herein. Based on the orientation input signal received from the orientation sensor 300 relative to two-dimensional tilt angles (i.e., pitch and roll), the controller 102 can determine the orientation of at least a portion of the inflatable garments 200, 200'. In one embodiment, the orientation sensor 300 comprises a two-axis or three-axis accelerometer. Alternatively, the orientation sensor 300 may comprise a tilt sensor or an inclinometer.

In operation, the orientation sensor 300 generates a reference plane for each axis, and measures the angular change relative to that one or more reference planes as will be readily understood by one of ordinary skill in the art. Furthermore, in embodiments where the orientation sensor 300 is a three-axis accelerometer, the method may comprise sensing the acceleration of the inflatable garment to which the orientation sensor 300 is coupled relative to three different axes.

The patient therapy device 100 may comprise more than one orientation sensor 300 in certain embodiments. These two or more orientation sensors 300 may be the same or different from one another. Thus, the inflatable garment may comprise two two-axis accelerometers such that the controller 102, through the combination of the orientation input signals received from these two-axis accelerometers can determine orientation relative to three different axes. The one or more orientation sensors 300 may be positioned at strategic locations on the inflatable garment such that the controller 102 can determine the orientation of one or more segments of a multi-segmented inflatable garment or other patient therapy device 100. For example, orientation sensors 300 can be located in each quadrant, or corner, of the inflatable garment. In other embodiments, each patient therapy device 100 may include only one orientation sensor 300.

Beyond allowing the controller 102 to discern the desired operational parameters based on the orientation input signal, the orientation sensor 300 may allow the controller 102 to further determine whether the patient has changed position, or in certain embodiments, whether the patient is in motion. For example, with reference to FIGS. 8A and 8B, based on the orientation input signal received from the orientation sensor 300, the controller 102 may determine whether the patient is lying-down (See FIG. 8A) or sitting-up (See FIG. 8B). The controller 102 may determine that the patient has changed position by comparing the actual orientation as determined based on the orientation input signal to an expected orientation for any number of positions. Alternatively, the controller 102 may compare the orientation input signal received at a first time with the orientation input signal received at a second time. Based on this comparison, the controller 102 may determine that the patient has changed position.

Figure 8A:
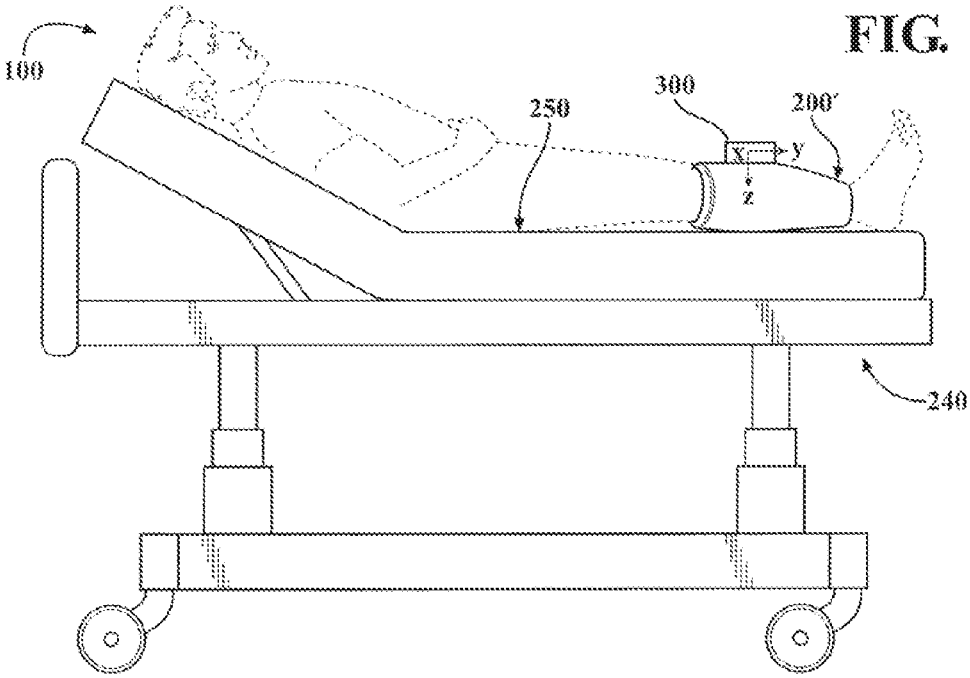
FIGS. 8A and 8B are side views of a patient in various positions relative to a patient support apparatus.
Figure 8B:
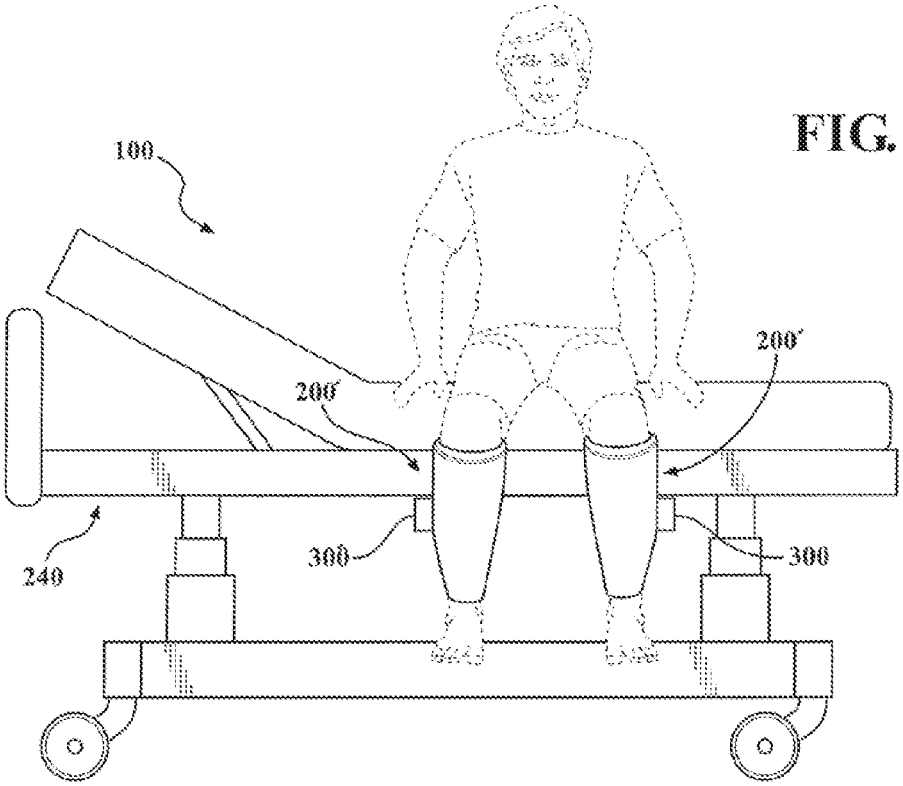

More particularly, in one specific embodiment, based on the orientation input signal received from the orientation sensor 300 coupled to the inflatable garment 200', the controller 102 may determine that the patient is in a lying-down position (FIG. 8A). Furthermore, after the patient has changed position to a sitting-up position, based on the orientation input signal received from the orientation sensor 300 coupled to the inflatable garment 200', the controller 102 may determine that the patient is in a sitting-up position. Thus, based on the orientation input signal received from the orientation sensor 300 coupled to the inflatable garment 200', the controller 102 can determine that the patient has changed positions, such as from the lying-down position to the sitting-up position, or from the sitting-up position to a standing-up position.

Depending on the type of therapy being delivered to the patient by the patient therapy device 100, the change of position may be of concern for the caregiver. For example, if the patient is wearing the inflatable garment 200', the change in position to a standing-up position or the sitting-up position is of concern to the caregiver because the change in position may indicate that the patient is intending to exit the patient support apparatus 240 and walk away. This may be problematic because the inflatable garment 200' positioned on the patient's calf may increase the likelihood that the patient may trip or fall when attempting to walk or stand. Thus, when the controller 102 receives an orientation input signal that indicates that the patient changed position, the controller 102 transmits an output signal that causes the alarm system 114 to notify the caregiver. For example, if the controller 102, based on the orientation input signal, determines that the patient has moved from a lying-down position to a sitting-up position, the controller 102 may send an output signal that causes the alarm system 114 to notify the caregiver of the change of position. By notifying the caregiver with the alarm system 114, the caregiver can take remedial action to eliminate the additional risk. For example, once the caregiver sees/hears the alarm system 114, the caregiver can remove the inflatable garment 200' from the patient's calf so that the patient can walk without the additional risk.

Figure 9:
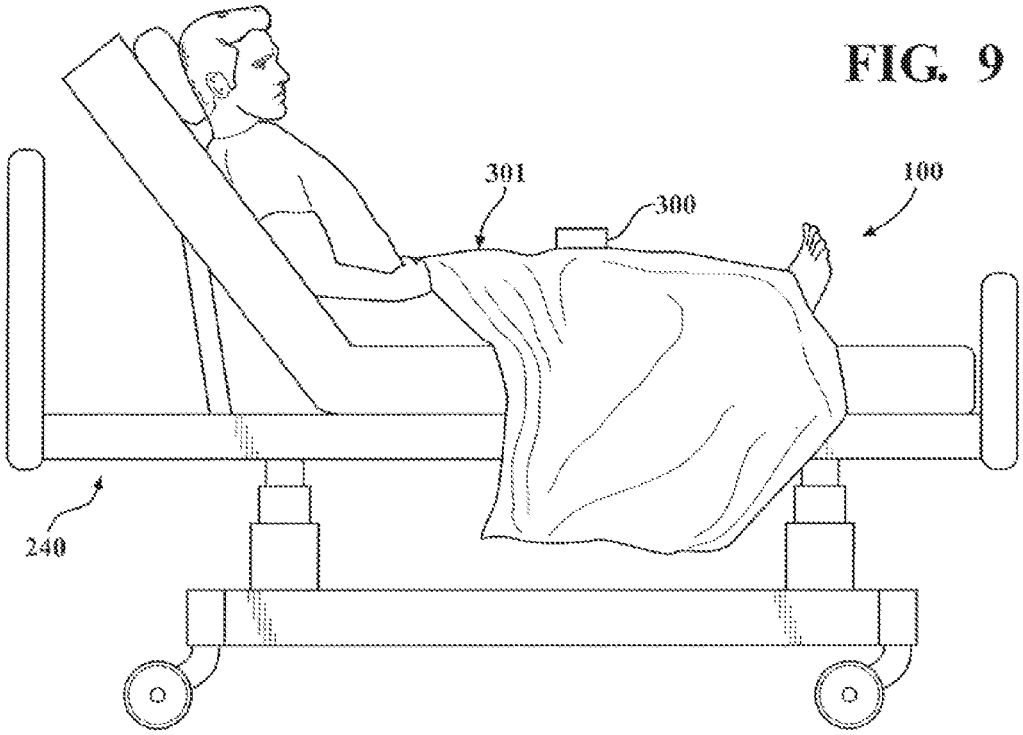
FIG. 9 is a side view of a patient warming device including an orientation sensor.

Referring to FIG. 9, the patient therapy device 100 is a warming device 301. One or more orientation sensors 300 may be coupled to the patient warming device 301. Based on the orientation input signal that the controller 102 receives from the orientation sensor of the patient warming device 301, the controller 102 may determine the desired operational parameter. Furthermore, based on the orientation input signal received from the orientation sensor 300, the controller 102 can determine whether the patient warming device 301 is positioned adjacent to a patient's torso, a patient's foot, or a patient's thigh. In one example, the controller 102, based on the orientation input signal, the controller 102 determines that the patient warming device 301 is in proximity to the patient's legs, and determines a desired operational parameter that is suitable for warming the legs of the patient, such as a predetermined maximum temperature or a predetermined temperature profile. Alternatively, if the controller 102, based on the orientation input signal received from the orientation sensor 300, determines that the patient warming device is positioned adjacent the upper body of the patient, the controller 102 may utilize one or more different operational parameters than if the patient warming device is positioned adjacent to the patient's foot or calf.

Referring to FIG. 10, a method of controlling the operational parameter of the patient therapy device 100 with the orientation sensor 300 is further provided. The method may comprise a step 302 of sensing an orientation of the inflatable garment with the orientation sensor, a step 304 of determining the desired operational parameter for the inflatable garment based on the sensed orientation of the inflatable garment; and a step 306 of controlling the fluid source based on the desired operational parameter for the inflatable garment.

In addition, the method may comprise a step of determining the type of the inflatable garment based on the sensed orientation of the inflatable garment. The step of sensing may comprise sensing the orientation of the inflatable garment relative to three different axes. The method may further comprise determining whether the patient is standing-up or sitting-up based on the sensed orientation of the inflatable garment, and alerting a caregiver if the controller determines that the patient is sitting-up or standing-up.

Referring to FIG. 11, in another embodiment, the detection system 104 comprises pressure-relief valves 400, 400'. The pressure-relief valves 400, 400' are configured to exhaust fluid from their respective fluid flow path when the pressure within the fluid flow path exceeds a predetermined pressure threshold. While the pressure-relief valves 400, 400' are shown in combination with the inflatable garments 200, 200', it is contemplated that the pressure-relief valves 400, 400' may be used with any suitable inflatable apparatus, including but not limited to mattresses, mattress toppers, patient turning systems, etc.

The pressure-relief valves 400, 400' may be coupled to the fluid flow path in any suitable location. For example, the pressure-relief valves 400, 400' may be coupled to the bladders 202, 202', the fluid supply tubes 210, or the connectors 216. The pressure-relief valves 400, 400' are coupled to the fluid flow path such that fluid inlets of the pressure relief valves 400, 400' are in fluid communication with the fluid flow paths, and fluid outlets of the pressure-relief valves 400, 400' are in fluid communication with the ambient environment.

During operation of inflatable garments 200, 200', i.e., inflation and deflation, the controller 102 receives the pressure input signal from the pressure sensors 222 (See FIG. 3) to determine the actual pressure within the flow fluid flow path for each inflatable garment 200, 200'. Based on the measured pressure within the fluid flow path, the controller 102 is configured to recognize a pattern of sensed pressures that indicate when the pressure-relief valves 400, 400' exhausted fluid from the fluid flow path, i.e., to recognize an exhaust event.

The recognition of the exhaust event is indicative that the pressure within the fluid flow path exceeded a predetermined threshold for at least some period of time. This is due to the fact that, during normal operation (in the absence of an exhaust event), the pressure within the fluid flow path would be expected to increase in a relatively stable manner while the fluid source 206 is continuously supplying fluid. However, when an exhaust event occurs, the pressure within the fluid flow path does not continue to increase even though the fluid source 206 continues to supply fluid. The fact that the pressure within the fluid path is not increasing despite the fact that the fluid source 206 is continuously providing additional fluid is because any additionally supplied fluid is being exhausted by the pressure relief valves 400, 400'. In summary, the controller 102 can analyze the pressure patterns and the status of the fluid source to determine whether the exhaust event has occurred.

The pressure relief valves 400, 400' may be configured to provide an audible alert when fluid is exhausted. Thus, the pressure relief valves 400, 400' may be configured to exhaust fluid through a port that is advantageously configured to make a whistling noise or other noise that is readily discernable by the caregiver. Alternatively, the controller 102 may be configured to detect the exhaust event and trigger an appropriate alert using the alarm system 114. In such an embodiment, the controller 102 may recognize the exhaust event and send an output signal to the alarm system 114 that causes the alarm system 114 to create an audible or visible alert to the caregiver. For example, the controller 102 may send an output signal to the alarm system 114 that triggers an illumination of one or more LED lights.

Referring now to FIG. 12, in one embodiment, the pressure-relief valve 400 comprises a spring-operated pressure-relief valve 400. Such a spring-operated pressure-relief valve comprises a fluid inlet 402, a disc 406 held against the fluid outlet 404 to prevent flow under normal system operation conditions, a spring 408 to hold the disc 406 against the fluid outlet 404, and a valve body 410 to house the disc 406 and the spring 408. As will be appreciated, the pressure at which the spring-operated pressure-relief valve 400 exhausts fluid can be adjusted by varying one or more parameters of spring 408, the geometry of the fluid outlet 404, or the geometry of the disc 406.

Of course, the configuration of the pressure-relief valves 400, 400' is not particularly limited, and may assume any conventional design other than the spring-operated pressure relief valve described herein. The predetermined pressure threshold may be customized based on the application by adjusting the geometry and/or materials of components on the pressure-relief valves 400, 400'. Furthermore, it is contemplated that the pressure-relief valves 400, 400' may be manual valves that are free from electronic components, and may operate independently of the controller 102.

Figure 13:
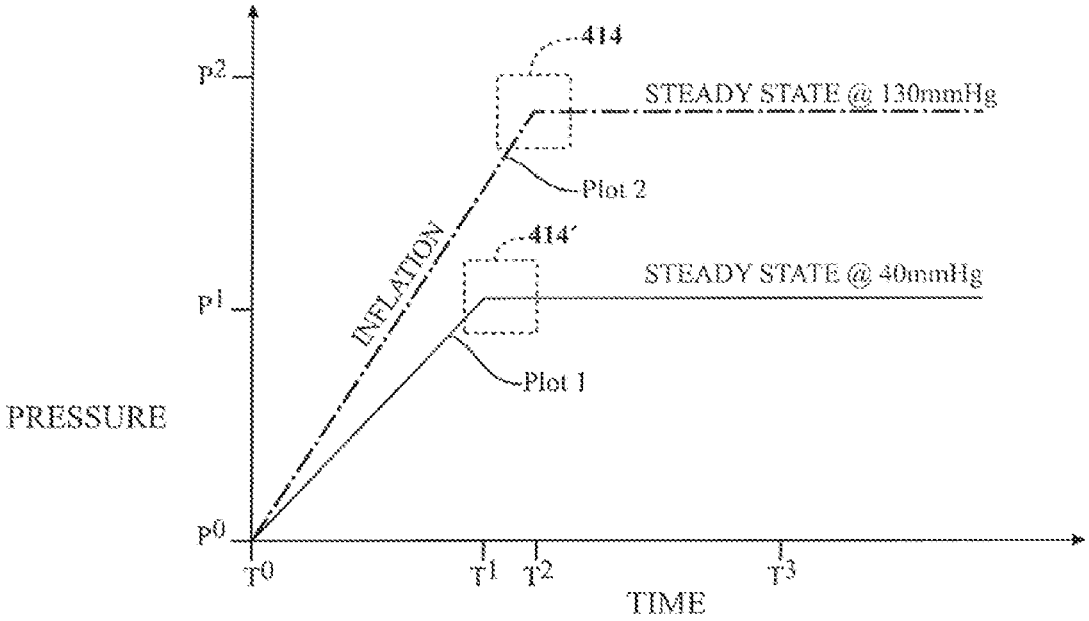
FIG. 13 is an exemplary pressure graph that display exhaust events for various inflatable garments.

Referring to FIG. 13, a chart illustrates the pressure over time within the fluid flow path for inflatable garments 200 and 200' over the course of a diagnostic cycle 412. Referring now to the Plot 1 for inflatable garment 200', the pressure in the fluid flow path steadily increases from $P^0$ to $P^1$ over the time period $T^0$ to $T^1$. However, despite continued operation of the fluid source 206 from the time period $T^1$ to $T^3$, the pressure does not exceed $P^1$. Based on this pressure input signal, and the fact that the pressure within the fluid flow path does not increase despite continued operation of the fluid source 206, the controller 102 is configured to recognize that an exhaust event 414' occurred at $T^1$. The exhaust event 414' is triggered by exhaustion of fluid through pressure-relief valve 400', and is indicative the pressure within the fluid flow path exceeded a predetermined pressure threshold, P1, illustrated at 40 mm Hg.

Referring to the Plot 2 for inflatable garment 200, the pressure in the fluid flow path steadily increases from $P^0$ to $P^2$ over the time period $T^0$ to $T^2$. However, despite continued operation of the fluid source 206 from the time period $T^2$ to $T^3$, the pressure does not exceed $P^2$. Based on this pressure input signal, and the fact that the pressure within the fluid flow path does not exceed $P^2$ despite continued operation of the fluid source 206, the controller 102 is configured to recognize that an exhaust event 414 occurred at $T^2$. This exhaust event 414 is triggered by exhaustion of fluid through the pressure-relief valve 400 and is indicative that the pressure within the fluid flow path exceeds a predetermined threshold, P2, illustrated at 130 mm Hg.

It is contemplated that the predetermined pressure threshold for the pressure relief valve 400 can be set for any suitable pressure, depending on the type of therapy being provide or based on the construction of the inflatable garment 200. Thus, the P1 and P2 pressure thresholds described above are provided merely for illustrative purposes and are not limiting.

The controller 102 determines a desired operational parameter for the inflatable garments 200, 200' based on the recognized exhaust events 414, 414'. The controller 102 transmits the output signal to control the fluid source 206 based on the desired operational parameters for the inflatable garments 200, 200'.

Based on the ability of the controller 102 to differentiate between different types of exhaust events, the controller 102 can recognize that different types of pressure-relief valves 400, 400' are present in the fluid flow path. For example, with further reference to FIG. 13, pressure relief valve 400 was configured to exhaust fluid at a different predetermined pressure threshold ($P^2$) than pressure relief valve 400' (exhausts at ($P^1$)). Based on the different pressure behavior as determined by the pressure input signal received from the pressure relief valves 400, 400', the controller 102 may determine different operational parameters for each of the inflatable garments 200, 200'. In other words, while the pressure sensors 222 may indicate a similar pressure behavior (i.e., a pressure measurement that increases gradually until the pressure no longer increases beyond the predetermined pressure threshold), the pressures at which the exhaust event occurs may be different for each of the inflatable garments 200, 200'.

The type of exhaust events that can be performed by the pressure relief valves 400, 400' and also recognized by the controller 102, are not particularly limited. The pressure-relief valves 400, 400' may be configured to exhaust fluid in a manner that yields a recognizable pressure pattern, and the controller 102 may be configured to recognize this recognizable pattern in the pressure within the fluid flow path to determine that an exhaust event occurs. For example, the controller 102 may determine that an exhaust event has occurred if the pressure within the fluid flow path temporarily drops below the predetermined pressure threshold, before becoming stable at the predetermined pressure threshold. Alternatively, the controller 102 may determine an exhaust event has occurred if the pressure within the fluid flow path sharply decreases below the predetermined pressure threshold before becoming stable at pressure below the predetermined pressure threshold. Of course, the types of pressure patterns that can be produced by the pressure-relief valve are not particularly limited.

As described above, once the exhaust events 414, 414' are recognized by the controller 102, the controller 102 is configured to determine a desired operational parameter based on the recognized exhaust event. For example, with reference to FIG. 13, because the controller 102 recognizes that the exhaust event 414 occurred at $P^2$, the controller 102 may determine that the inflatable garment 200 is the inflatable foot garment. Accordingly, the controller 102 may determine desired operational parameters for the inflatable garment 200 that are suitable to deliver therapy to the foot of the patient. Alternatively, if the controller 102 recognizes that the exhaust event 414' occurred at $P^1$, the controller 102 may determine that the inflatable garment 200' is configured to deliver therapy to a patient's calf, and may determine the desired operational parameters accordingly. The types of operational parameters are not particularly limited, as described above with other detection systems 104. After the controller 102 determines the desired operational parameters for the inflatable garments 200, 200' based on the recognized exhaust event, the controller 102 may control the fluid source 206 based on the desired operational parameter for the inflatable garments 200, 200'.

Figure 14:
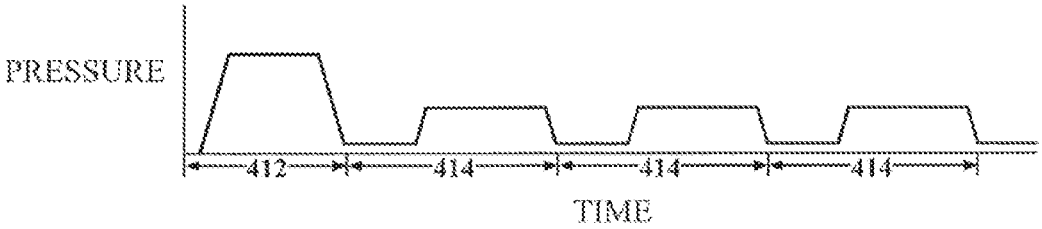
FIG. 14 is an exemplary pressure graph that displays diagnostic and normal operation cycles for an inflatable garment.

Referring to FIG. 14, the controller 102 controls the fluid source 206 based on the desired operational parameters so that the pressure within the fluid flow path does not exceed the predetermined pressure threshold after the diagnostic cycle 412 is completed. Accordingly, the predetermined pressure threshold of the pressure-relief valves 400, 400' may represent a global maximum relative to the pressure sustained by the inflatable garments 200, 200' during all cycles of the inflatable garments 200, 200' (i.e., both the diagnostic cycles and the normal operation cycles). Thus, during one or more normal operation cycles 416, the controller 102 controls the fluid source 206 such that the pressure in the fluid flow path does not exceed the predetermined pressure threshold of the pressure-relief valve 400, 400'. In other words, the fluid source 206 may provide fluid to the inflatable garment during the diagnostic cycle 412, during which the pressure within the fluid flow path exceeds the predetermined pressure threshold, and the controller 102 recognizes the exhaust event. Subsequent to the diagnostic cycle 412, the controller 102 may transmit an output signal to the fluid source 206 which causes the fluid source 206 to operate in normal operation cycles 416 in order to deliver therapy to the patient such that exhaust events do not occur between the normal operation cycles. However, it should be further appreciated that the controller 102 may control the fluid source 206 such that one or more exhaust events occur periodically, i.e., the controller 102 may control the fluid source 206 such that diagnostic cycles 412 are intermittently spaced between one or more normal operation cycles 416 to ensure that the controller 102 maintains calibration.

In embodiments where the controller 102 controls the fluid source 206 such that the pressure within the fluid flow path does not exceed the predetermined pressure threshold during normal operation, it is contemplated that one or more fault conditions may exist. For example, the pressure sensor 222 may malfunction, or the controller 102 may fail, which may cause the pressure within the fluid flow path to exceed a desired level. In such an embodiment, the pressure-relief valve 400, 400' may exhaust fluid from the fluid flow path after the diagnostic cycle 412 if the pressure within the fluid flow path exceeds the predetermined threshold. This functionality allows the pressure-relief valve 400, 400' to serve dual purposes—create the exhaust event that is recognizable by the controller 102, and provide pressure-relief in case one or more fault conditions develop. Thus, by virtue of recognizing exhaust events, as opposed to merely valve signatures, the described method and system eliminates the need for a valve that is solely intended to create a pressure behavior that can be recognized by the controller 102.

The controller 102 may be configured to determine whether the pressure-relief valve 400, 400' performed an exhaust event at a time that a normal operation cycle is expected to occur. If the controller 102 determines that the pressure-relief valve 400, 400' performed an exhaust event at an unexpected time, the controller 102 may send an output signal to the alarm system 114. The alarm system 114 alerts the caregiver that the fault condition is present.

Figure 15:
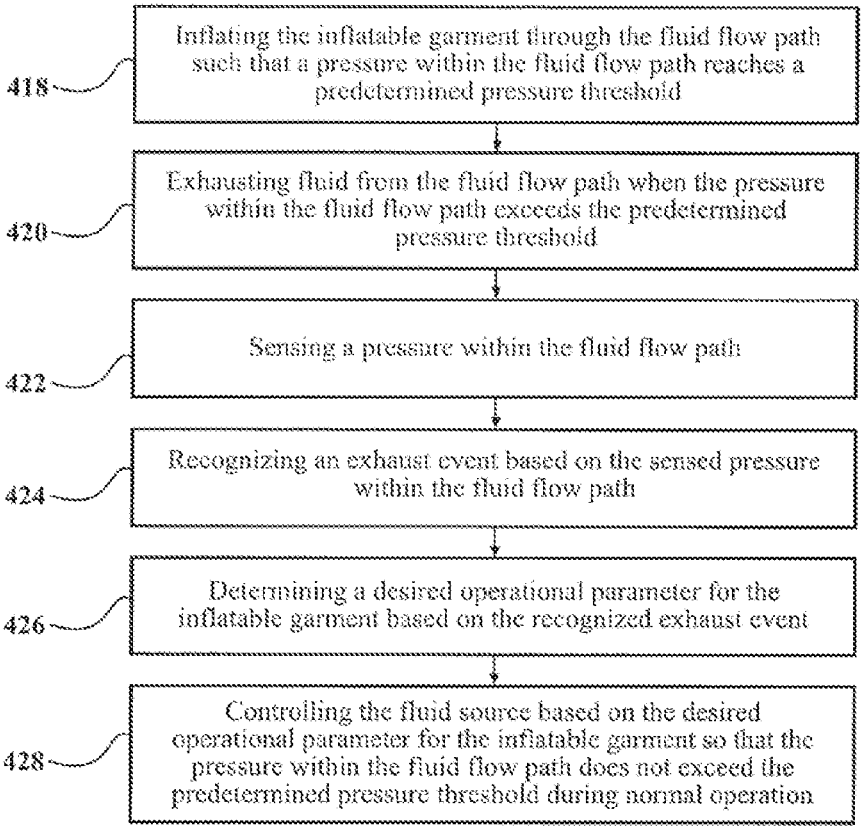
FIG. 15 is a schematic view for a method of using a detection system that comprises a pressure-relief valve.

Referring to FIG. 15, a method of controlling the operational parameter of an inflatable garment in fluid communication with a fluid source using the pressure-relief valve is also provided. The method comprises: a step 418 of inflating the inflatable garment through the fluid flow path such that a pressure within the fluid flow path reaches a predetermined pressure threshold; a step 420 of exhausting fluid from the fluid flow path when the pressure within the fluid flow path exceeds the predetermined pressure threshold; a step 422 of sensing a pressure within the fluid flow path; a step 424 of recognizing an exhaust event based on the sensed pressure within the fluid flow path; a step 426 of determining a desired operational parameter for the inflatable garment based on the recognized exhaust event; and a step 428 of controlling the fluid source based on the desired operational parameter for the inflatable garment so that the pressure within the fluid flow path does not exceed the predetermined pressure threshold during normal operation.

The method may further comprise determining a fault condition if the pressure within the fluid flow path exceeds a fault pressure threshold, and alerting a caregiver if the fault condition is present. In addition, or as an alternative, the method may comprise determining a fault condition if the pressure within the fluid flow path is below the fault pressure threshold, and alerting a caregiver if the fault condition is present. It should be appreciated that the predetermined pressure threshold of the pressure relief valve 400 may be the same of different as the fault pressure threshold. For example, in one embodiment, the fault pressure threshold is below the predetermined pressure threshold of the pressure relief valve 400. Such an arrangement provides an early alert of the fault condition before the pressure relief valve 400 performs the exhaust event.

The step of recognizing the exhaust event may comprise recognizing a pressure at which the pressure-relief valve begins exhaust fluid from the fluid flow path. The method may comprise determining a type of inflatable garment based on the recognized exhaust event.

In yet another embodiment, the detection system 104 is configured to detect the type of the patient therapy device 100 based on a fluid volume of the patient therapy device 100. This type of detection system 104 is particularly useful to detect inflatable apparatuses that have a fixed fluid volume, such as the inflatable garments 200, 200', 200", and for which the times needed to inflate the inflatable garments 200, 200', 200" is different.

Referring to FIG. 1, in this embodiment, the detection system 104 comprises the timer 116. The timer 116 is coupled to controller 102. Referring to FIG. 3, the inflatable garments 200, 200', 200", the fluid source 206, and the pressure sensors 222 are also provided as described above.

During volume-based detection, one of the inflatable garments 200, 200', 200" are fluidly coupled to the fluid source 206. The controller 102 transmits an output signal to control the fluid source 206 to initiate a diagnostic inflation cycle. During the diagnostic inflation cycle, the fluid source 206 may continuing providing fluid to the bladder 202, 202', 202" of the inflatable garment 200, 200', 200" until the controller 102 determines that, based on the pressure input signal provided by the pressure sensor 222, the actual pressure within the fluid flow path reaches a predetermined pressure threshold. Once the controller 102 determines that the pressure within the fluid flow path reaches the predetermined pressure threshold, the controller 102 transmits an output signal to control the fluid source 206 such that the fluid source 206 ceases inflating the bladder 202, 202' 202" of the inflatable garments 200, 200', 200".

The timer 116 is configured to determine a duration of time elapsed for the pressure within the fluid flow path to reach the predetermined pressure after the diagnostic inflation cycle was initiated. In other words, the timer 116 measures the duration of time that has elapsed between the time that the controller 102 transmits the output signal to the fluid source 206 to initiate the diagnostic inflation cycle and the time the controller 102 transmits the output signal to the fluid source 206 to cease inflation of the inflatable garment 200, 200', 200".

Figure 16:
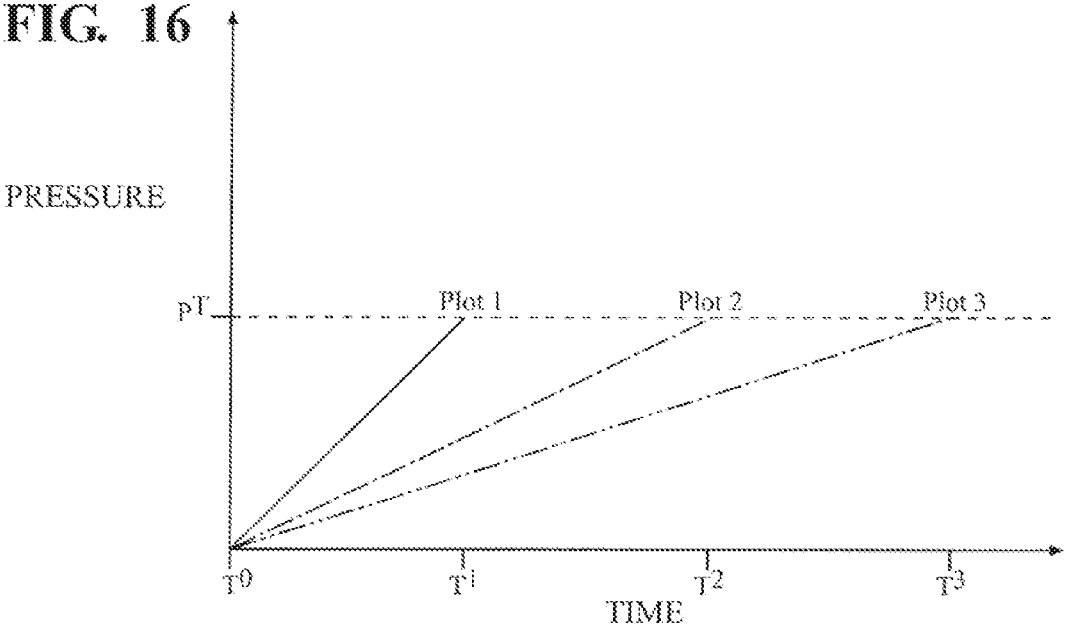
FIG. 16 is an exemplary pressure graph that displays the duration of inflation for various inflatable garments.

Referring to FIG. 16, based on the duration of time determined by the timer 116 to reach the predetermined pressure threshold $P^T$, the controller 102 may determine the type of inflatable garment 200, 200', 200" that is coupled to the fluid source 206 since, based on empirical testing, each type has different times to reach the threshold pressure $P^T$. By measuring the duration of inflation needed to reach the pressure threshold with the timer 116, the controller 102 can differentiate between the different types of inflatable garments 200, 200', 200". For example, referring to Plot 1, for the inflatable garment 200, the duration of inflation needed to reach the pressure threshold is T1 (approximately 12 seconds), whereas, referring to Plot 2, for the inflatable garment 200', the duration of inflation needed to reach the pressure threshold $P^T$ is T2 (approximately 14 seconds) and, referring to Plot 3, for the inflatable garment 200", the duration of inflation needed to reach the pressure threshold is T3 (approximately 20 seconds). Thus, based on these differing durations of inflation, the controller 102 may differentiate between the inflatable garments 200, 200', 200".

Based on the duration of time determined by the timer 116, the controller 102 is further configured to determine the desired operational parameters for the inflatable garments 200, 200', 200". Thus, based on the duration of time of 12 seconds for the inflatable garment 200, the controller 102 determines operational parameters appropriate for delivering therapy to the patient's foot. Based on the duration of time of 14 seconds for the inflatable garment 200', the controller 102 determines operational parameters appropriate for delivering therapy to the patient's calf. Based on the duration of 20 seconds for the inflatable garment 200", the controller 102 determines operational parameters appropriate for delivering therapy to the patient's thigh. As described above, the desired operational parameters are not particularly limited, and the illustrated durations are provided as mere examples.

The controller 102 may further compare the actual duration measured by the timer 116 with an expected duration of time. The expected duration of time data may be provided in a look-up table. The look-up table may include expected durations of time for one or more different types of inflatable apparatuses and/or inflatable garments. This may comprise durations of times for different types of foot garments, different types of calf garments, etc. The expected duration of time look-up table may be populated through empirical testing of specific inflatable garments or may be populated by mathematical analysis.

In addition to the timer 116, in certain embodiments, the detection system 104 for volume-based detection may further utilize the patient sensor 110 described above to ensure that the inflatable garment 200, 200', 200" is positioned adjacent to the patient, i.e., in a use position, prior to enabling the diagnostic cycle. If the inflatable garments 200, 200', 200" are not positioned adjacent to the patient, the pressure profiles measured will not correlate to the expected pressure profiles being evaluated by the controller 102. As a result, the controller 102 were to determine the duration of inflation while the inflatable garment 200, 200', 200" was not in the use position, e.g. being worn by the patient, the controller 102 may determine desired operational parameters that are not ideally-suited to operation of the inflatable garment 200, 200', 200". Thus, the controller 102, based on the patient input signal received from the patient sensor 110, may prevent initiation of the diagnostic cycle for inflatable garment 200, 200', 200" if the inflatable garment 200, 200', 200" is not in the use position on the patient. Alternatively, or in addition, the controller 102 may cooperate with the alarm system 114 to notify a caregiver that the inflatable garment 200, 200', 200" is not in a use position on a patient when the diagnostic cycle is initiated.

Figure 17:
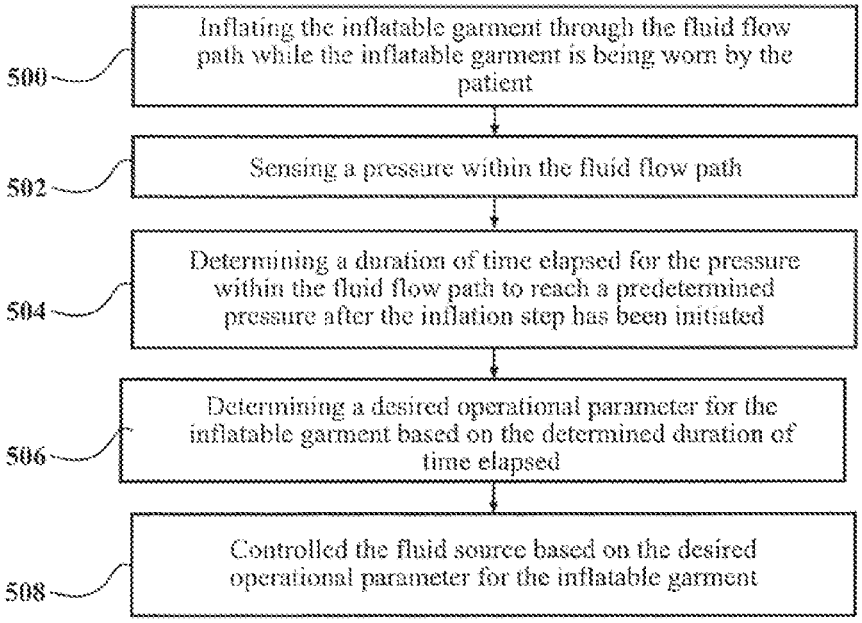
FIG. 17 is a flow diagram for a method of using a detection system that comprises a timer.

Referring to FIG. 17, a method for controlling an operational parameter of an inflatable apparatus with the timer is provided. The method may comprise: a step 500 of inflating the inflatable garment through the fluid flow path while the inflatable garment is being worn by the patient; a step 502 of sensing a pressure within the fluid flow path; a step 504 of determining a duration of time elapsed for the pressure within the fluid flow path to reach a predetermined pressure after the inflation step has been initiated; step 506 of determining a desired operational parameter for the inflatable garment based on the determined duration of time elapsed; and a step 508 of controlling the fluid source based on the desired operational parameter for the inflatable garment.

The method may additionally comprise sensing whether the inflatable garment is positioned adjacent to the patient, and preventing the inflating step from initiating if the inflatable garment is not positioned adjacent to the patient. The method may further comprise determining a type of inflatable garment based on the determined duration of time elapsed.

Figure 18:
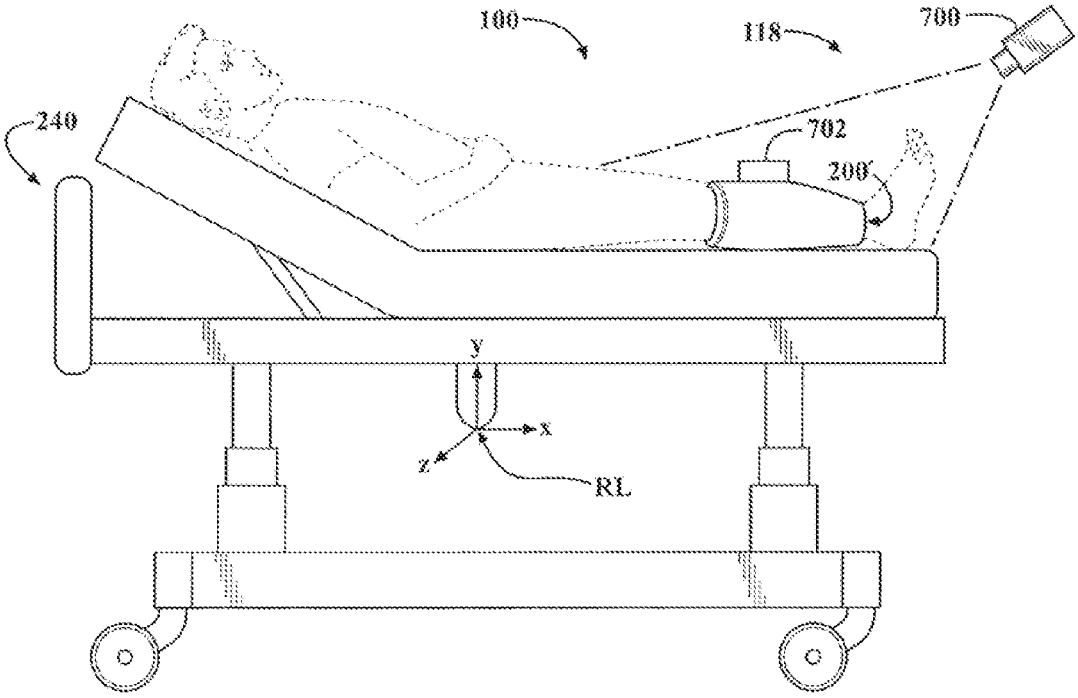
FIG. 18 is a side view of a patient support apparatus and an optical locating system.

Referring now to FIG. 18, the locating system 118 may be configured to generate the location input signal based on a location of the patient therapy device 100, shown as the inflatable garment 200' relative to a reference location RL.

In such a configuration, the locating system 118 identifies one or more relative positions of the inflatable garment 200' with respect to the reference location RL. The locating system 118 may communicate with the controller 102 in any suitable manner, such as wirelessly or through physical communication lines.

For example, as illustrated in FIG. 18, if the locating system 118 is utilized in combination with the patient support apparatus 240, the reference location RL may be chosen by the manufacturer of the patient support apparatus 240. Alternatively, the reference location RL comprises the geometrical center of the patient support apparatus 240.

In another possible configuration, the reference location RL is a vertical axis aligned with the center of gravity or center of mass of the patient support apparatus 240. In such a configuration, the patient support apparatus 240 may be configured to determine a center of gravity of a patient disposed on the patient support surface 250, and assign the reference location RL based on the sensed center of gravity of the patient such as one or more load cells. In such an embodiment, the patient support apparatus 240 may comprise one or more sensors (not shown) configured to generate a center of gravity input signal based on a center of gravity of the patient. These sensors may be communicate with the controller 102 in any suitable manner, such as wirelessly or through physical communication lines. The controller 102 may be configured to assign the reference location RL based on this center of gravity input signal. In still other embodiments, the reference location RL is a detected location of one or more parts of the patient's body, which allows the locating system 118 to determine the proximity of the patient therapy device 100 to specific portions of the patient's body.

However, it should be appreciated that any suitable reference location RL, and any suitable methodology to establish the reference location RL may be utilized. Furthermore, it is contemplated that the reference location RL may be defined in any suitable manner that is particular to the type of locating system 118 being utilized.

As illustrated in FIG. 18, the locating system 118 comprises an optical locating system. In such an embodiment, the locating system 118 comprises an optical detection device 700, such as a camera or scanner. The optical detection device 700 may be positioned in any suitable location, such as in the corner of the hospital room, attached to a boom, or a component of the patient support apparatus 240. The optical detection device 700 may be configured to provide a location input signal to the controller 102 that is indicative of the location of the inflatable garment 200'.

The type of optical location sensing is not particularly limited. For example, the optical detection device 700 may utilize infrared or visible light to detect the location of the inflatable garment 200'. In certain embodiments, the optical detection device 700 utilizes image-recognition analysis to determine the location of the inflatable garment 200' in the field of view or area of detection of the optical detection device 700.

The patient therapy device 100 may comprise a detection element 702 in certain embodiments. The locating system 118 may be configured to determine a location of the detection element 702. Based on the determined location of the detection element 702, the locating system 118 can determine the location of the patient therapy device 100. Depending on the type of locating system 118 that is utilized, the detection element 702 may assume many forms and configurations. For example, if the locating system 118 utilizes optical technology, the detection element 702 is optically-detectable, and if the locating system 118 utilizes electromagnetic technology, the detection element 702 is electromagnetically-detectable.

In cooperation with the optical detection device 700, detection element 702 may comprise an optical reference unit. The detection element 702 may be coupled to the inflatable garment 200' in any suitable manner. In certain embodiments, the detection element 702 is coupled to the inflatable garment 200' in a manner where the detection element 702 would be expected to be visible to the optical detection device 700 while the inflatable garment 200' is in use, i.e., being worn by the patient. Thus, the detection element 702 may be mounted on an outer surface of the inflatable garment 200'. The optical detection device 700 may be programmed to identify and locate the detection element 702 within its field of view or detection. Once the optical detection device 700 locates the detection element 702, the optical detection device 700 may determine the precise location of the inflatable garment 200' to which the detection element 702 is coupled.

The optical detection device 700 may further cooperate with the reference location RL. The reference location RL may be optically identifiable by the optical detection device 700 in a manner that allows the optical detection device 700 to determine the location of the inflatable garment 200' relative to the reference location RL. In other words, the reference location RL permits the controller 102 to define the location of the inflatable garment 200' in a frame of reference that has its origin located at the reference location RL so that no additional calculations to determine the location of the inflatable garment 200' need to be made.

Referring to FIG. 18, as mentioned above, the locating system 118 may provide the location input signal to the controller 102. The controller 102 may utilize one or more algorithms to determine the location of the inflatable garment 200' based on the location input signal received from the locating system 118. The controller 102 can determine, based on the location input signal provided by the locating system 118 that the inflatable garment 200' is located adjacent to the patient's right calf.

Based on the determined location of the inflatable garment 200', the controller 102 may be configured to determine the type of inflatable garment 200', i.e., determine that the inflatable garment 200' is the calf garment. Furthermore, based on the determined location of the inflatable garment 200', the controller 102 may be configured to determine a desired operational parameter for the inflatable garment 200'. In the example above, the controller 102 may determine that the inflatable garment 200' is the inflatable calf garment and is configured to deliver therapy to the patient's calf. Accordingly, the controller 102 may determine the desired operational parameters appropriate for the inflatable garment 200' that is appropriate, and control the fluid source 206 accordingly. As described above, a variety of desired operational parameters may be determined, depending on the type of patient therapy device utilized.

Figure 19:
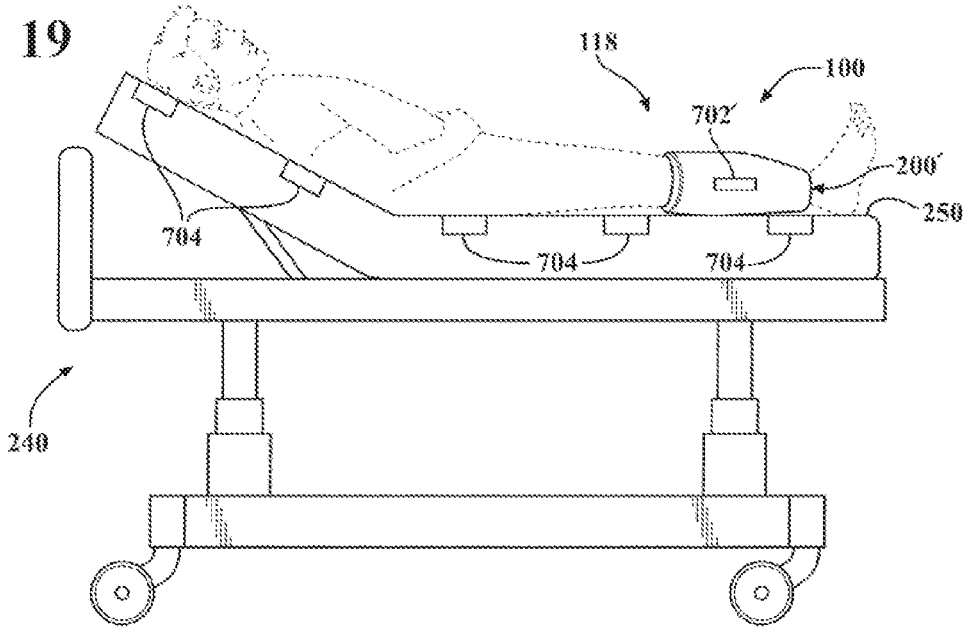
FIG. 19 is side view of a patient support apparatus and an electromagnetic sensing system.

In another embodiment, the locating system 118 comprises an electromagnetic locating system. Referring to FIG. 19, in such a configuration, the locating system 118 comprises one or more electromagnetic sensors 704 positioned adjacent to the patient's body, such as disposed on the patient support surface 250 of the patient support apparatus 240, or in an upper layer of a mattress. Of course, in certain embodiments, the electromagnetic sensors 704 are arranged such they will be expected to contact the patient when the patient is positioned atop the patient support apparatus 240. The electromagnetic sensors 704 may communicate with the controller 102 in any suitable manner, such as wirelessly or through physical communication lines.

Any suitable electromagnetic sensors 704 may be utilized in conjunction with the electromagnetic sensing system. Suitable electromagnetic sensors include, but are not limited to, location detection devices operable in accordance with known capacitive, inductive, or other physical principles. In any case, all such electromagnetic sensors are contemplated by this disclosure. In one embodiment, the electromagnetic sensors are capacitive sensors. In other embodiments, the electromagnetic sensors are near-field detection sensors.

Each of the electromagnetic sensors 704 are configured to produce a voltage or current signal to the controller 102 that are indicative of the location of the inflatable garment 200' in relation to each of the electromagnetic sensors 704, such as proximity of the inflatable garment 200' to the specific electromagnetic sensor 704.

In certain configurations of the electromagnetic locating system, the detection element 702' comprises an electromagnetic tag. The detection element 702' may be coupled to the inflatable garment 200' in any suitable manner. During use, the one or more electromagnetic sensors 704 may detect and locate the detection element 702'. As the one or more electromagnetic sensors 704 detect and locate detection element 702', the controller 102 may determine the precise location of the inflatable garment 200' to which the detection element 702' is coupled. The mode of operation and configuration of detection element 702' is not particularly limited, and may be configured to cooperate with any known electromagnetic sensing technology, such as radiofrequency detection, near-field detection, and others as will be appreciated by those of ordinary skill in the art.

Figure 20:
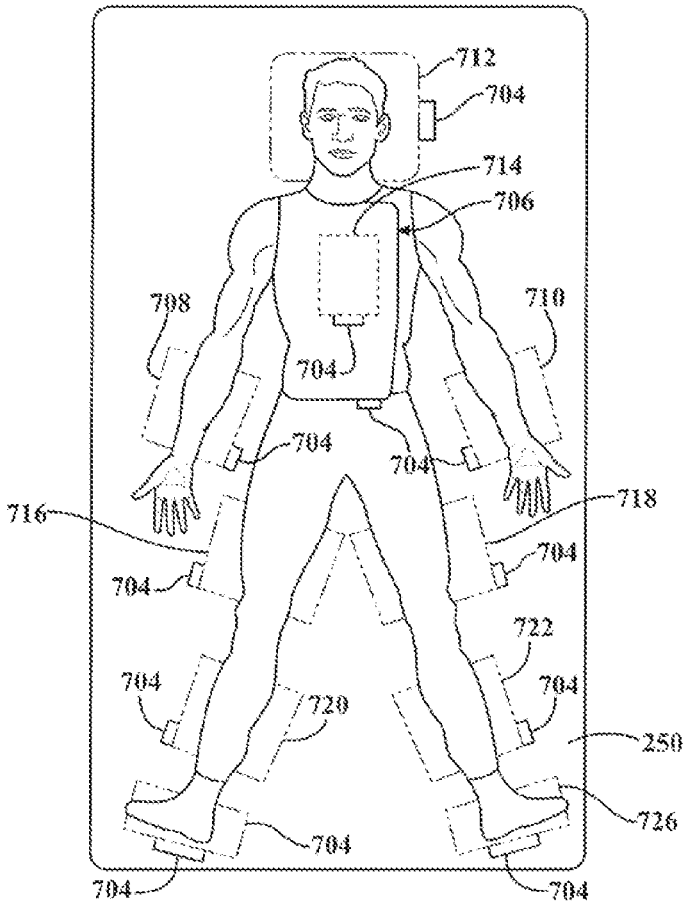
FIG. 20 is a plan view of a patient support apparatus including detection zones.

Referring to FIG. 20, the locating system 118 may be configured to detect the location of the patient therapy device 100 in a plurality of detection zones. The plurality of detection zones may be arranged so as to overlay the entire patient support surface 250, or may be arranged to overlay an area less than the entire patient support surface 250. In one configuration, the plurality of detection zones comprises a right arm zone 708, a left arm zone 710, a head zone 712, a chest zone 714, a right thigh zone 716, a left thigh zone 718, a right calf zone 720, a left calf zone 722, a left foot zone 724, a right foot zone 726, or any combination thereof. Each of the plurality of detection zones may correspond to a part of the patient's body to which the patient therapy device 100 may be coupled to. Each of the plurality of detection zones comprises a suitable number of the electromagnetic sensors 704 to allow the locating system 118 to determine whether the patient therapy device 100 is within the respective detection zone. Of course, it is also contemplated that one of the electromagnetic sensors 704 may be used to detect the patient therapy device 100 in multiple detection zones, or that multiple electromagnetic sensors 704 may be used to monitor the location of the patient therapy device 100 in a single detection zone.

One electromagnetic sensor 704 is provided for each of the plurality of detection zones. The actual locations of the various electromagnetic sensors 704 are not particularly limited, and the locations of the electromagnetic sensors 704 shown in the illustrated embodiment are provided only by way of example. The locations of the electromagnetic sensors 704 may therefore be different for different applications, such as locating systems that utilize different types of electromagnetic detection technology, thus, the electromagnetic sensors may be part of one or more of the side rails 252, 254, 256, 258, headboard 260, or footboard 262.

Based on the detection zone in which the patient therapy device 100 is positioned, the controller 102 may be configured to determine the desired operational parameter for the patient therapy device 100. Thus, in FIG. 20, the patient therapy device 100 is a chest therapy device 706 that is positioned adjacent to a patient's chest, and based on the location input signal, the controller 102 determines that the chest therapy device 706 is positioned in the chest detection zone 714. As such, the controller 102 controls the chest therapy device 706 with operational parameters that appropriate for delivering therapy to the patient's chest.

Figure 21A:
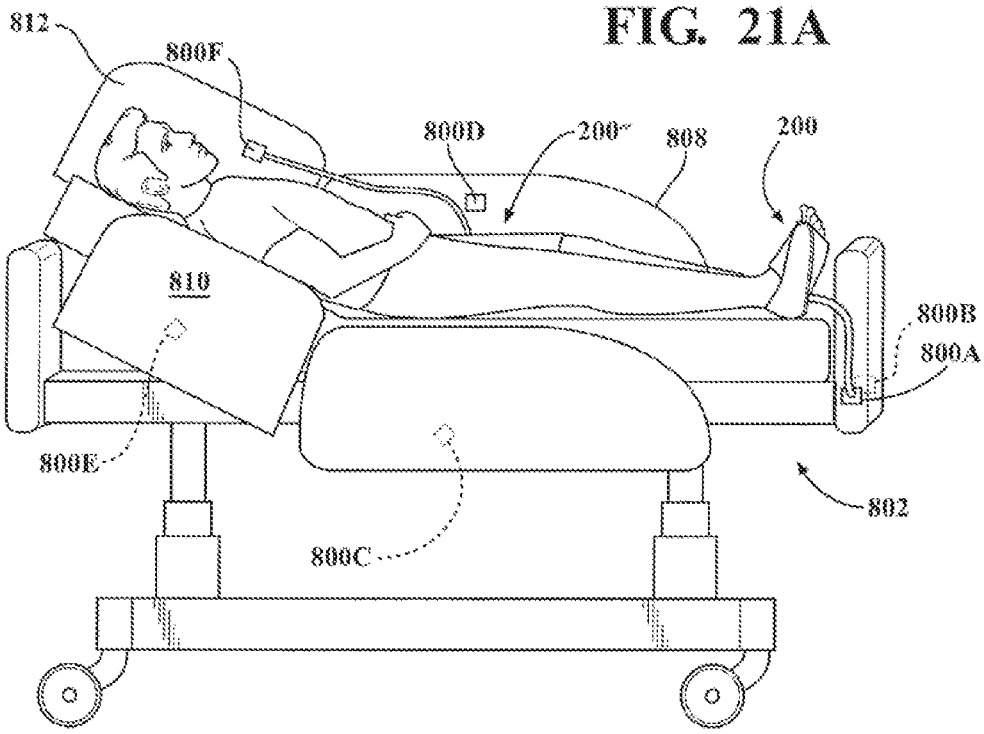
FIG. 21A is a perspective view of a patient support apparatus including coupling ports.

In yet another embodiment, with reference to FIG. 21A, the locating system 118 comprises one or more coupling ports 800*a*, 800*b*, 800*c*, 800*d*, 800*e*, 800*f* positioned adjacent various components of a patient support apparatus 802. Each of the plurality of coupling ports 800*a*, 800*b*, 800*c*, 800*d*, 800*e*, 800*f* are in fluid communication with the fluid source 206. The locating system 118 is configured to determine the location of the inflatable garments 200, 200', 200" based on which of the plurality of coupling ports 800 the inflatable garments 200, 200' are coupled to, and provide the corresponding location input signal to the controller 102.

Each of plurality of coupling ports 800 are provided in distinct locations on the patient support apparatus 802, for example, coupling ports 800*a* is provided on the right side of the foot board 804, the coupling port 800*b* is provided on the left side of the foot board 804, the coupling port 800*c* is provided on side rail 806, the coupling port 800*d* is provided on side rail 808, the coupling port 800*e* is provided on side rail 810, and the coupling port 800*f* is provided on side rail 812.

Figure 21B:
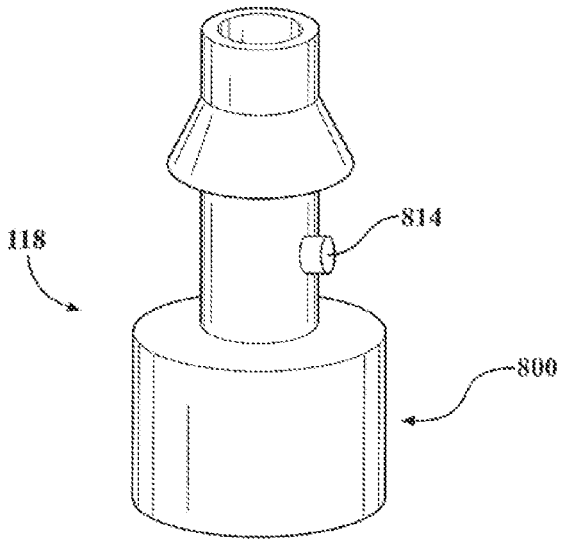
FIG. 21B is a close-up view of one of the coupling ports of FIG. 21A.

In addition, with reference to FIG. 21B, each of the plurality of coupling ports 800*a*, 800*b*, 800*c*, 800*d*, 800*e*, 800*f* may comprise a coupling sensor 814 that are configured to determine whether the inflatable garments 200, 200', 200" are coupled to each respective coupling port 800*a*, 800*b*, 800*c*, 800*d*, 800*e*, 800*f*. The coupling sensors 814 may communicate with the controller 102 in any suitable manner, such as wirelessly or through physical communication lines. While the type of coupling sensor 814 is not particularly limited, exemplary coupling sensors 814 may comprise limit switches or load cells that provide a coupling input signal to locating system 118 that indicates to which of the plurality of coupling ports the inflatable garments 200, 200', 200" are coupled. Alternatively, the controller 102 can deduce which of the coupling ports 800*a*, 800*b*, 800*c*, 800*d*, 800*e*, 800*f* are engaged by the inflatable garments 200, 200', 200" using a pressure sensor, or other suitable detection methodology.

With reference to FIG. 21A, the inflatable garment 200 is coupled to the coupling port 800*a*. Thus, the coupling sensor 814 associated with that coupling port 800*a* provides a coupling input signal to the controller 102 that indicates that the inflatable garment 200 is coupled to the right side of the footboard 804, which provides a corresponding location input signal to the controller 102. The controller 102 may utilize one or more look-up tables or algorithms to determine that, based on the coupling of inflatable garment 200 to coupling port 800*a*, that the inflatable garment 200 is the inflatable foot garment, and that the desired operational parameters should be those appropriate for delivering therapy to the patient's foot. Furthermore, the inflatable garment 200' is coupled to the coupling port 800*f*. Thus, the coupling sensor 814 associated with that coupling port 800*c* provides a coupling input signal to the controller 102 that indicates that the inflatable garment 200" is coupled to side rail 812, which provides a corresponding location input signal to the controller 102. The controller 102, based on this location input signal, determines that the inflatable garment 200" is a inflatable thigh garment, and that the desired operational parameters should be those appropriate for delivering therapy to the patient's thigh.

Figure 22:
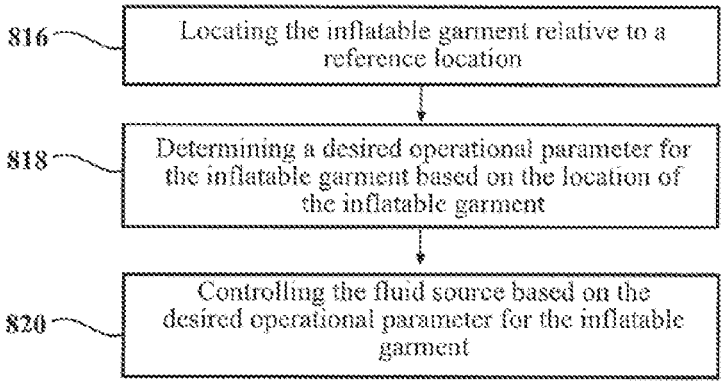
FIG. 22 is a flow diagram for a method of using a detection system that comprises a locating system.

A method of utilizing the locating system is further provided in FIG. 22. The method may comprise: a step 816 of locating the inflatable garment relative to a reference location; step 818 of determining a desired operational parameter for the inflatable garment based on the location of the inflatable garment; and a step 820 of controlling the fluid source based on the desired operational parameter for the inflatable garment.

The method may further comprise determining a type of inflatable garment based on the location of the inflatable garment. In addition, the method may including sensing a center of gravity of patient disposed on a patient support surface, and assigning the reference location based on the center of gravity of the patient.

Figure 23A:
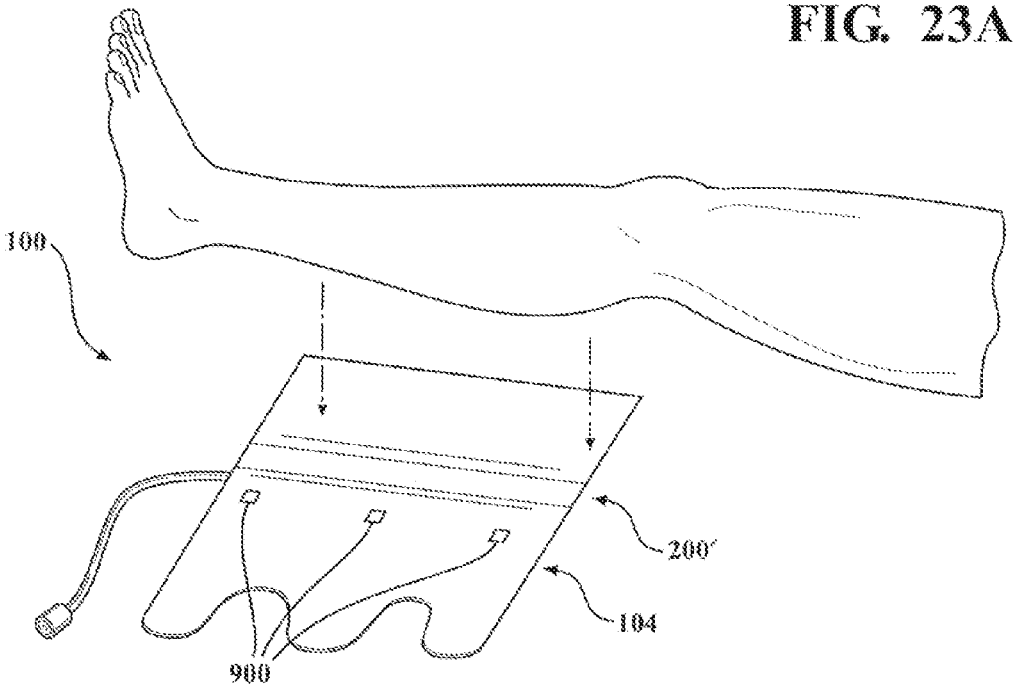

Referring to FIGS. 23A and 23B, in a further embodiment, the detection system 104 comprises a skin sensor 900 coupled to the patient therapy device 100. The controller 102 is configured to determine the desired operational parameter for the patient therapy device 100 based on a skin input signal provided by the skin sensor 900.

The skin sensor 900, in the example illustrated in FIG. 23A, is coupled to the inflatable garment 200'. In the exemplary embodiment, the skin sensor 900 is configured to generate a skin input signal based on the type of skin that the skin sensor 900 is positioned adjacent to, or contacts. For example, the skin sensor 900 may further generate different skin input signals that allows the controller 102 to differentiate between various types of skin, such as the skin of a patient's calf, foot, chest, back, arm, hand, wrist, forearm, upper arm, thigh, neck, head, stomach, or a portion thereof. The skin sensor 900 may communicate with the controller 102 in any suitable manner, such as wirelessly or through physical communication lines.

Based on the skin input signal received from the skin sensor 900, the controller 102 is configured to determine the type of skin to which the inflatable garment 200' is coupled. Based on the type of skin to which the inflatable garment 200' is coupled, the controller 102 may determine the desired operational parameters that are appropriate for that skin type. Furthermore, based on the type of skin to which the inflatable garment 200' is coupled, the controller 102 may determine the type of inflatable garment 200' that is positioned adjacent to the portion of the patient's body.

The skin sensor 900 can be located at any feasible location on the inflatable garment 200' such that the skin sensor 900 will be positioned adjacent to, or make contact with, the skin of the patient during use of the inflatable garment 200'. The skin sensor 900 may be attached or coupled to the inflatable garment 200' in any suitable manner. For example, the skin sensors 900 may removably coupled to the inflatable garments 200' by attachment with a hook and loop system or through other forms of mechanical attachment. Alternatively, the skin sensors 900 may be permanently attached to the inflatable garment 200' with adhesive, ultrasonic welding, or other suitable attachment.

In one embodiment, the skin sensor 900 is configured to contact skin of a patient and may be dimensioned and arranged accordingly. The skin sensor 900 is configured to generate the skin input signal based on a characteristic of the skin that is engaged by the skin sensor 900. Any suitable skin characteristics can be sensed, including, but not limited to skin impedance, skin light transmission, skin conductivity, and combinations thereof. A variety of different types of skin sensing technology may be utilized by the skin sensor 900. For example, the skin sensor 900 may detect the characteristic using skin optical detection (i.e., photonics), or electrical skin detection, (i.e., capacitive sensing or impedance sensing). In one embodiment, the skin sensor 900 comprises an impedance sensor that detects the impedance of the skin contacted by the impedance sensor. As will be appreciated, in some embodiments, such as with skin optical detection, the skin sensor 900 need not be placed in direct contact with the skin.

The controller 102 may determine the sensed characteristic of the skin based on the input signal provided by the skin sensor 900. The controller 102 may be further configured to determine a desired operational parameter for the inflatable garment 200' based on the sensed characteristic of the skin. In one embodiment, the controller 102 may determine the desired operational parameter by utilizing a look-up table or suitable algorithm. Thus, the controller 102 may compare the sensed skin characteristic to a look-up table and determine what operational parameters are suitable for the sensed skin characteristic. Of course, in certain embodiments, the look-up table of skin characteristics may include a range of values for each skin characteristic to account for the natural variation in skin characteristics from patient to patient.

The desired operational parameter is not particularly limited, as described above. In one embodiment, the controller 102, based on the type of skin that is engaged by the skin sensor 900, may determine the desired operational parameters. For example, the type of skin may be associated with a combination of one or more different operational parameters.

With reference to FIG. 23A, the skin sensor 900 contacts the patient's calf, and the controller 102 may determine that skin contacted by skin sensor 900 has an impedance of 1,000 ohms. Based on this impedance, the controller 102 may determine that the skin sensor is coupled to the inflatable garment 200', e.g., the inflatable calf garment, and determine desired operational parameters that are appropriate to deliver therapy to the patient's calf.

With reference to FIG. 23B, the skin sensor 900 contacts the bottom of the patient's foot, and the controller 102 may determine that skin contacted by skin sensor 900 has an impedance of 25,000 ohms. Based on this impedance, the controller 102 may determine that the skin sensor is coupled to the inflatable garment 200, e.g., the inflatable foot garment, and determine desired operational parameters that are appropriate to deliver therapy to the patient's foot.

The controller 102 may utilize a look-up table or algorithm to determine type of skin associated with the one or more sensed skin characteristics. Thus, for any given skin characteristic measurement, the controller 102 is configured to determine the corresponding type of skin.

Referring to FIG. 24, a method of using the skin sensor is further provided. The method may comprise: a step 902 of contacting skin of the patient with the skin sensor; a step 904 of sensing a characteristic of the contacted skin; a step 906 of determining the desired operational parameter for the patient therapy device based on the sensed characteristic of the skin; and a step 908 of controlling the patient therapy device based on the desired operational parameter.

The method may further comprise controlling the fluid source based on the desired operational parameter. The method may comprise determining a type of inflatable garment based on the sensed characteristic of the skin. Alternatively, or in addition, the method may comprise determining a type of skin contacted by the skin sensor. In certain embodiments, the step of sensing the characteristic of the contacted skin comprises sensing an impedance of the contacted skin.

The step of contacting the skin of the patient with the skin sensor may comprise contacting skin of the patient on a bottom of the foot of the patient, wherein sensing the characteristic of the contacted skin comprises sensing the characteristic of the contact skin on the bottom of the foot of the patient. Alternatively, the step of contacting skin of the patient with the skin sensor comprises contacting skin on a calf of the patient, and wherein sensing a characteristic of the contacted skin comprises sensing the characteristic of the contacted skin on the calf of the patient.

Figure 25A:
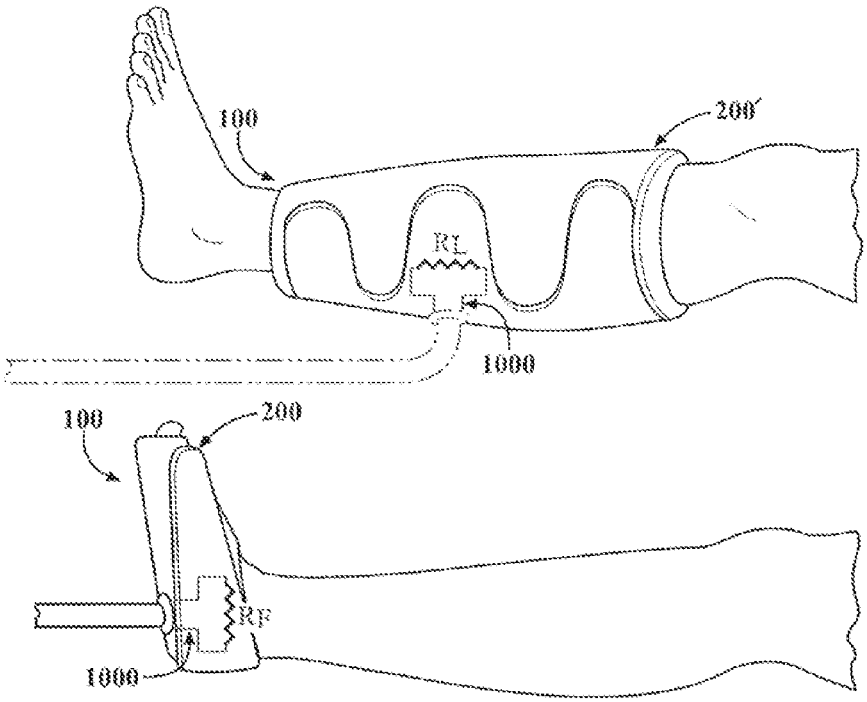
FIGS. 25A and 25B are plan views for inflatable garments and connectors that comprise an electrical circuit.
Figure 25B:
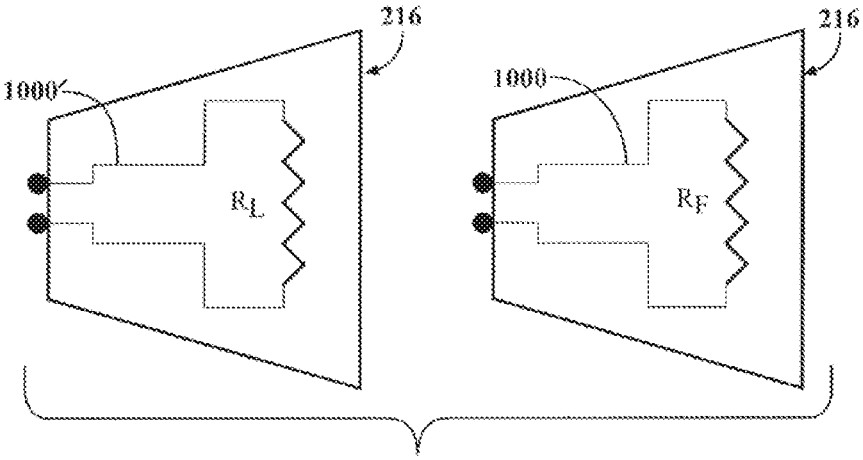
Figure 27:
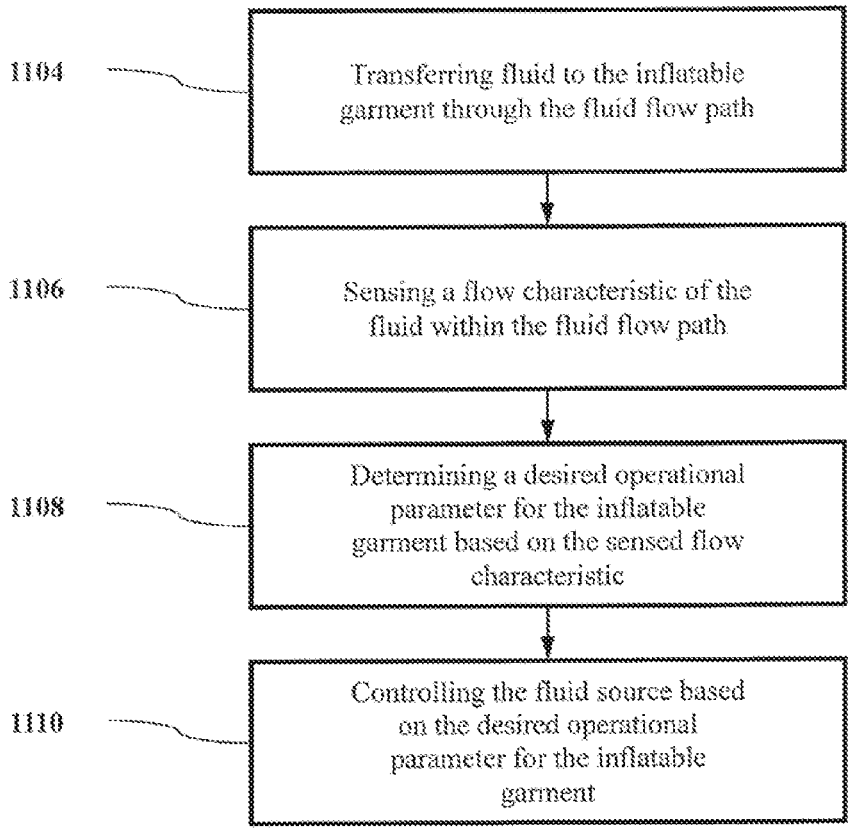
FIG. 27 is a flow diagram for a method of using a detection system that comprises a flow sensor.

In another embodiment, with reference to FIGS. 25A and 25B, the detection system 104 comprises electrical circuits 1000, 1000' having predetermined electrical signatures. The electrical circuits 1000, 1000' may be coupled to the patient therapy device 100, such as the inflatable garments 200, 200'. The predetermined electrical signatures 1000, 1000' may be identifiable by the controller 102 to determine a desired operational parameter for the inflatable garments 200, 200'.

While the electrical circuit 1000, 1000' may be coupled to the inflatable garments 200, 200' in any suitable manner, it is specifically contemplated that the electrical circuits 1000, 1000' may be coupled to the bladders 202, 202', the fluid supply tubes 210, and/or the connectors 216. Referring specifically to FIG. 25A, the electrical circuits 1000, 1000' are coupled to the bladders 202, 202' of the inflatable garments 200, 200'. Referring specifically to FIG. 25B, the electrical circuits 1000, 1000' are provided in the connectors 216 of the inflatable garments 200, 200'.

The electrical circuits 1000, 1000' may be specifically configured such that they exhibit a particular predetermined electrical signature having one or more predetermined electrical parameters. Thus, the predetermined electrical signature be selected from the group comprising a predetermined impedance value, a predetermined resistance value, and combinations thereof.

The inflatable garment 200 comprises electrical circuit 1000, which comprises 130 kΩ resistance, whereas inflatable garment 200' comprises electrical circuit 1000' that comprises 40 kΩ resistance.

The controller 102 is configured to identify the predetermined electrical signature, and determine the desired operational parameter based on identified electrical signature of electrical circuits 1000, 1000'. The type of identification is not particularly limited, and thus, the controller 102 may measure the characteristic of the electrical circuits 1000, 1000' associated with each of the inflatable garments 200, 200', and determine the operational parameters based on the determined electrical characteristic. The controller 102 may cooperate with any suitable identification devices, such as digital signal processors, to identify the predetermined electrical characteristic of the electrical circuits 1000, 1000'. As part of the determining process, the controller 102 may apply a known signal to the electrical circuits 1000, 1000', and based on the response of the electrical circuits 1000, 1000', the controller 102 may identify the predetermined electrical signature of the electrical circuit 1000, 1000'.

The controller 102 may be further configured to determine a desired operational parameter for the inflatable garments 200, 200' based on the predetermined electrical signature. The desired operational parameter is not particularly limited, as described above. In one example, because the controller 102 determines the electric characteristic to be 40 kΩ resistance for the inflatable garment 200', the controller 102, based on the predetermined electrical signature detected, may determine the desired operational parameters suitable to deliver therapy to the patient's calf. Because the controller 102 determines that the electrical characteristic is 130 kΩ resistance for the inflatable garment 200, the controller 102, based on the predetermined electrical signature detected, may determine the desired operational parameters suitable to deliver therapy to the patient's foot. Furthermore, the controller 102, may be configured based on the predetermined electrical signature detected, may determine the type of inflatable garment 200, 200' that is coupled to the electrical circuit 1000, 1000', i.e., that the inflatable garment 200 is the inflatable foot garment; and that the inflatable garment 200' is the inflatable calf garment.

In yet another embodiment, the detection system 104 is further configured to detect the type and operational parameters of the patient therapy device 100 based on a fluid flow characteristic of the patient therapy device 100. Referring to FIG. 26A, in such an embodiment, the detection system 104 includes a flow control element 1100 and a flow sensor 1102 that is configured to measure the fluid flow characteristics of fluid that is transferred to the patient therapy device 100. Additionally, this embodiment may include the pressure sensor 222, which may be used to sense the pressure of the fluid across the fluid supply tube 210. The controller 102 is configured to determine the desired operational parameter based on the fluid flow characteristic determined by the flow sensor 1102. While inflatable garments 200, 200', 200" are shown in FIG. 26A, it should be understood that this detection system 104 may be further utilized with respect to temperature-control garments, where this detection system 104 controls the operational parameters of the temperature-control garments based on the fluid flow characteristic of the fluid that is transferred to those temperature-control garments, such as the warming blanket illustrated in FIG. 9.

In the illustrated embodiment, the flow control element 1100 is a venturi device 1100 that is positioned along the fluid flow path by virtue of its placement on the fluid supply tube 210. However, it should be appreciated that the type of flow control element 1100 is not particularly limited, and may include any device that affects the flow characteristic of fluid that passes from the fluid source 206. By way of non-limiting example, the fluid control element 1102 may comprise an orifice, a regulator, a nozzle, etc. Furthermore, it should further be appreciated that the flow control element 1100, 1100', 1100" may be positioned in other locations, including in the connector 216, at the garment supply port 204, or within the inflatable garment 200, 200', 200".

Furthermore, in certain embodiments, a separate fluid control element 1100 need not be included, and the flow characteristics of fluid transmitted to the inflatable garments 200, 200', 200" can be controlled by deliberate or inherent configurations of the inflatable garments 200, 200', 200", such as the shape and fluid paths within the bladders 202, 202', 202"; the volume of the bladders 202, 202', 202", the existence of constrained flow paths within the bladders 202, 202', 202" or other configurations that would affect the flow characteristics of fluid that is transferred to the inflatable garments 200, 200', 200". Similarly, the flow rate of fluid transferred to the inflatable garments 200, 200', 200" can be controlled by deliberate or inherent configurations of the fluid supply tube 210, such as the length of the fluid supply tube 210, the shape of the fluid supply tube 210 (such as being curvilinear or straight, i.e, coiled, or straight tubing), the cross-sectional area of the lumen of the fluid supply tube 210, etc.

The flow sensor 1102 is configured to provide a flow characteristic input signal to the controller 102 that is indicative of the fluid flow characteristic of the fluid that is transferred from the fluid source 206 to the bladders 202, 202', 202" of the inflatable garments 200, 200', 200". More specifically, the flow sensor 1102 is configured to provide a flow characteristic input signal to the controller 102, and the controller 102 is configured to determine the flow characteristic based on the flow characteristic input signal. It should be appreciated the configuration and location of the flow sensor 1102 is not particularly limited, as any suitable flow sensor 1102 may be utilized. Furthermore, two or more flow sensors 1102 may be employed, each located at different points in the fluid flow path. The flow sensor 1102 may communicate with the controller 102 in any suitable manner, such as wirelessly or through physical communication lines.

Based on the characteristic of flow sensed by the flow sensor 1102, the controller 102 is configured to determine the type of inflatable garment 200, 200', 200" that is coupled to the fluid source 206. In one embodiment, the controller 102 may determine the desired operational parameter by utilizing a look-up table or suitable algorithm. Thus, the controller 102 may compare the sensed flow characteristic to a look-up table and determine what operational parameters are suitable for the sensed skin characteristic.

With reference to FIG. 26A, fluid control elements 1100, 1100', 1100" may each have different designs in that a supplied fluid having a given initial pressure passing through each of the fluid control elements 1100, 1100', 1100" would pass through each of the fluid control elements 1100, 1100', 1100" at a different flow rate. This different flow rate would be sensed by the flow sensor 1100 that is coupled adjacent to each of the fluid control elements 1100, 1100', 1100". Thus, the flow rate for fluid passing through the fluid control elements 1100, 1100', 1100" would be different for each of the inflatable garments 200, 200', and 200".

Referring to FIG. 26B, a chart illustrates the flow volume over time within the fluid flow path for inflatable garments 200, 200', 200". Based on the flow volume over time (i.e., the flow rate), the controller 102 may determine the type of inflatable garment 200, 200', 200" that is coupled to the fluid source 206 since. Based on empirical testing, each fluid control element 1100, 1100', 1100" results in a different flow rate. By measuring the flow rates of fluid entering each of the inflatable garments 200, 200', 200", the controller 102 can differentiate between the different types of inflatable garments 200, 200', 200". For example, referring to Plot 1, for the inflatable garment 200, the flow rate sensed by flow sensor 1102 is $R^1$; referring to Plot 2, for the inflatable garment 200', the flow rate sensed by flow sensor 1102 is $R^2$; and referring to Plot 3, for the inflatable garment 200", the flow rate sensed by flow rate sensor 1102 is $R^3$.

Based on the flow rates ($R^1$, $R^2$, $R^3$) determined by the flow sensor 1102, the controller 102 is further configured to determine the desired operational parameters for the inflatable garments 200, 200', 200". Thus, based on the flow rate of $R^1$ for the inflatable garment 200, the controller 102 determines operational parameters appropriate for delivering therapy to the patient's foot. Based on the flow rate of $R^2$ for the inflatable garment 200', the controller 102 determines operational parameters appropriate for delivery therapy to the patient's calf. Based on the flow rate of $R^3$ for inflatable garment 200", the controller 102 determines operational parameters appropriate for delivering therapy to the patient's thigh. As described above, the desired operational parameters are not particularly limited. Furthermore, it should be appreciated that the controller 102 may be configured to recognize any flow rate and determine appropriate operational parameters for any flow rate.

Furthermore, although the flow rate is described as a basis of detection in FIG. 26B and the accompanying description, the flow sensor 1102 may be used to sense other characteristics of the fluid supplied to the inflatable garments 200, 200', 200" other than flow rate, including but not limited to, fluid resistance. Similarly, the fluid control elements 1102, 1102', 1102" may be configured to change other fluid parameters of the fluid flow path other than the fluid flow rate. Accordingly, the controller 102 may determine the desired operational parameters based on flow characteristics other than the flow rate, such as the fluid resistance.

A method of controlling the operational parameter based on a flow characteristic of a fluid transferred to the inflatable garment is further contemplated. The method includes a step 1104 of transferring fluid to the inflatable garment; a step 1106 of sensing a flow characteristic of the fluid within the fluid flow path; a step 1108 determining a desired operational parameter for the inflatable garment based on the sensed flow characteristic; and a step 1110 of controlling the fluid source based on the desired operational parameter for the inflatable garment. The method may further include heating or cooling the fluid before transferring the fluid to the inflatable garment with a suitable heating device or a suitable cooling device.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed:

1. A system for controlling compression therapy, said system comprising:

a fluid source;

a controller configured to control said fluid source;

an inflatable garment comprising an inflatable bladder, a fluid supply tube comprising a first end and a second end, and a connector, said connector coupled to said fluid supply tube at said first end, said inflatable bladder coupled to said fluid supply tube at said second end, wherein said inflatable bladder, said fluid supply tube, and said connector cooperate to define a fluid flow path, said connector configured to be removably coupled to and receive fluid from said fluid source;

a pressure sensor operatively coupled to said fluid flow path, said pressure sensor configured to generate an input signal based on a pressure within said fluid flow path; and a pressure-relief valve operatively coupled to said fluid flow path, said pressure-relief valve configured to exhaust fluid from said fluid flow path when said pressure within said fluid flow path exceeds a predetermined pressure threshold, said predetermined pressure threshold corresponding to a maximum inflation pressure sustained by said inflatable garment during all therapy cycles of said inflatable garment, wherein said controller is configured to: receive said input signal; recognize an exhaust event based on said input signal, determine a type of said inflatable garment and a desired operational parameter for said inflatable garment based on said recognized exhaust event, and transmit an output signal to control said fluid source based on said desired operational parameter for said inflatable garment.

2. The system of claim 1, wherein said pressure-relief valve is coupled to one of said inflatable bladder, said fluid supply tube, and said connector.

3. The system of claim 2, wherein said pressure sensor is coupled to one of said inflatable bladder, said fluid supply tube, and said connector.

4. The system of claim 1, wherein said inflatable garment is configured to provide therapy to a foot of the patient or is configured to provide therapy to a calf of the patient.

5. The system of claim 1, wherein said inflatable garment is further defined as a first inflatable garment, said pressure-relief valve is further defined as a first pressure-relief valve, and said predetermined pressure threshold is further defined as a first pressure relief threshold, and further comprising a second inflatable garment comprising a second pressure-relief valve having a second predetermined pressure threshold, wherein said first predetermined pressure threshold of said first pressure-relief valve of said first inflatable garment exceeds said second predetermined pressure threshold.

6. The system of claim 5, wherein said first inflatable garment and said second inflatable garment are configured to be operated with different operational parameters.

7. The system of claim 1, wherein said pressure-relief valve is the only valve coupled to said fluid flow path that is capable of exhausting fluid from said fluid flow path.

8. A system for controlling therapy, said system comprising:

a fluid source;

a controller configured to control said fluid source;

an inflatable garment comprising an inflatable bladder, a fluid supply tube comprising a first end and a second end, and a connector, said connector coupled to said fluid supply tube at said first end, said inflatable bladder coupled to said fluid supply tube at said second end, wherein said inflatable bladder, said fluid supply tube, and said connector cooperate to define a fluid flow path, said connector configured to be removably coupled to and receive fluid from said fluid source; and a flow sensor operatively coupled to said fluid flow path, said flow sensor configured to generate an input signal based on a flow characteristic of fluid transferred within said fluid flow path, wherein said controller is configured to: receive said input signal; determine a type of said inflatable garment and a desired operational parameter for said inflatable garment based on said flow characteristic, and transmit an output signal to control said fluid source based on said desired operational parameter for said inflatable garment.

9. The system of claim 8, wherein said inflatable garment is a temperature-control garment.

10. The system of claim 8, wherein said flow sensor comprises a flow rate sensor.

11. The system of claim 8, further comprising a fluid control element that alters the flow characteristic of fluid being transferred through the fluid flow path, wherein the fluid control element is disposed within said fluid flow path.

12. The system of claim 11, wherein said fluid control element comprises a venturi element.

13. The system of claim 11, wherein said fluid control element comprises an orifice element.

* * * * *